US009700766B2

(12) United States Patent
Sugimae et al.

(10) Patent No.: US 9,700,766 B2
(45) **Date of Patent: *Jul. 11, 2017**

(54) GOLF CLUB HEAD WITH IMPROVED STRIKING FACE

(71) Applicant: Acushnet Company, Fairhaven, MA (US)

(72) Inventors: Ryuichi Sugimae, Oceanside, CA (US); Uday V. Deshmukh, Carlsbad, CA (US); Heng-Jui Henry Yeh, TaoYuan (TW)

(73) Assignee: Acushnet Company, Fairhaven, MA (US)

( * ) Notice: Subject to any disclaimer, the term of this patent is extended or adjusted under 35 U.S.C. 154(b) by 48 days.

This patent is subject to a terminal disclaimer.

(21) Appl. No.: 14/814,371

(22) Filed: Jul. 30, 2015

(65) Prior Publication Data

US 2015/0360093 A1 Dec. 17, 2015

Related U.S. Application Data

(63) Continuation of application No. 13/854,817, filed on Apr. 1, 2013, now Pat. No. 9,433,835.

(51) Int. Cl.
*A63B 53/04* (2015.01)
*C22F 1/18* (2006.01)

(52) U.S. Cl.
CPC ..... *A63B 53/0466* (2013.01); *A63B 53/04* (2013.01); *C22F 1/183* (2013.01);
(Continued)

(58) Field of Classification Search
USPC ..... 473/324–350
See application file for complete search history.

(56) References Cited

U.S. PATENT DOCUMENTS 1,318,325 A 10/1919 Klin
1,319,233 A 10/1919 Mattern
(Continued)

FOREIGN PATENT DOCUMENTS

CN 1114911 1/1996
GB 2268693 A 1/1994
(Continued)

OTHER PUBLICATIONS

Golf Digest, Sep. 1982, p. 25.
(Continued)

*Primary Examiner* — Alvin Hunter
(74) *Attorney, Agent, or Firm* — Randy K. Chang

(57) ABSTRACT

A golf club head with an improved striking face is disclosed herein. More specifically, the present invention utilizes an innovative die quenching method that can alter the Young's modulus of the material of the striking face. The striking face portion of the present invention generally created from an α+β titanium alloy such as SP 700 that contains a β rich alloy composition to create more phase change in the alloying elements. In a preferred embodiment, the die quenching process could create a localized change in the material's Young's modulus throughout different regions of the striking face, resulting in a change in the Young's modulus of the material within the same striking face.

13 Claims, 20 Drawing Sheets

(52) U.S. Cl.
CPC . *A63B 2053/042* (2013.01); *A63B 2053/0416* (2013.01); *A63B 2053/0462* (2013.01)

(56) References Cited

U.S. PATENT DOCUMENTS 1,467,435 A 9/1923 Kinneak
1,525,352 A 2/1925 Aitken
1,543,691 A 6/1925 Beat
1,582,836 A 4/1926 Link
1,589,363 A 6/1926 Butchart
1,595,589 A 8/1926 Tyler
1,605,551 A 11/1926 Mattern
1,699,874 A 1/1929 Buhrke
1,704,119 A 3/1929 Buhrke
1,704,165 A 3/1929 Buhrke
1,720,867 A 7/1929 Webster
2,034,936 A 3/1936 Barnhart
2,087,685 A 7/1937 Hackney
2,176,845 A 10/1939 Temple
2,662,537 A 12/1953 Doyle
3,334,882 A 8/1967 Rossbach
3,567,228 A 3/1971 Lynn
3,571,900 A 3/1971 Hardesty
3,619,184 A * 11/1971 Bomberger, Jr. ..... C22C 14/00 420/419
3,625,518 A 12/1971 Solheim
3,659,855 A 5/1972 Hardesty
3,863,932 A 2/1975 Lezatte
3,985,363 A 10/1976 Jepson et al.
4,023,802 A 5/1977 Jepson et al.
4,193,601 A 3/1980 Reid, Jr. et al.
4,213,613 A 7/1980 Nygren
4,214,754 A 7/1980 Zebelean
D267,965 S 2/1983 Kobayashi
4,429,879 A 2/1984 Schmidt
4,432,549 A 2/1984 Zebelean
4,449,707 A 5/1984 Hayashi et al.
4,451,041 A 5/1984 Hayashi et al.
4,451,042 A 5/1984 Hayashi et al.
4,465,221 A 8/1984 Schmidt
4,471,961 A 9/1984 Masghati et al.
4,489,945 A 12/1984 Kobayashi
4,511,145 A 4/1985 Schmidt
4,762,324 A 8/1988 Anderson
4,792,140 A 12/1988 Yamaguchi et al.
4,826,172 A 5/1989 Antonious
4,842,243 A 6/1989 Butler
4,913,438 A 4/1990 Anderson
4,915,385 A 4/1990 Anderson
4,915,386 A 4/1990 Antonious
4,919,430 A 4/1990 Antonious
4,919,431 A 4/1990 Antonious
4,921,252 A 5/1990 Antonious
4,928,965 A 5/1990 Yamaguchi et al.
4,930,781 A 6/1990 Allen
4,932,658 A 6/1990 Antonious
4,955,610 A 9/1990 Creighton et al.
D312,858 S 12/1990 Anderson et al.
5,000,454 A 3/1991 Soda
5,024,437 A 6/1991 Anderson
5,028,049 A 7/1991 McKeighen
5,046,733 A 9/1991 Antonious
5,056,705 A 10/1991 Wakita et al.
5,060,951 A 10/1991 Allen
5,067,715 A 11/1991 Schmidt et al.
5,090,702 A 2/1992 Viste
5,094,383 A 3/1992 Anderson
5,106,094 A 4/1992 Desbiolles et al.
5,141,230 A 8/1992 Antonious
5,163,682 A 11/1992 Schmidt et al.
5,180,166 A 1/1993 Schmidt et al.
5,183,255 A 2/1993 Antonious
5,213,328 A 5/1993 Long et al.
5,221,087 A 6/1993 Fenton et al.
5,240,252 A 8/1993 Schmidt et al.
5,242,167 A 9/1993 Antonious
5,255,918 A 10/1993 Anderson et al.
5,261,663 A 11/1993 Anderson
5,261,664 A 11/1993 Anderson
5,271,621 A 12/1993 Lo
5,292,129 A 3/1994 Long et al.
5,295,689 A 3/1994 Lundberg
5,301,945 A 4/1994 Schmidt et al.
5,318,300 A 6/1994 Schmidt et al.
5,328,184 A 7/1994 Antonious
5,344,140 A 9/1994 Anderson
5,346,218 A 9/1994 Wyte
5,351,958 A 10/1994 Helmstetter
5,358,249 A 10/1994 Mendralla
5,362,047 A 11/1994 Shaw et al.
5,362,055 A 11/1994 Rennie
5,366,223 A 11/1994 Werner et al.
5,380,010 A 1/1995 Werner et al.
5,390,924 A 2/1995 Antonious
5,395,113 A 3/1995 Antonious
5,397,126 A 3/1995 Allen
5,401,021 A 3/1995 Allen
5,405,136 A 4/1995 Hardman
5,405,137 A 4/1995 Vincent et al.
5,407,202 A 4/1995 Igarashi
RE34,925 E 5/1995 McKeighen
5,417,419 A 5/1995 Anderson et al.
5,417,559 A 5/1995 Schmidt
5,423,535 A 6/1995 Shaw et al.
5,429,357 A 7/1995 Kobayashi
5,431,396 A 7/1995 Shieh
5,433,440 A 7/1995 Lin
5,447,307 A 9/1995 Antonious
5,447,309 A 9/1995 Vincent
5,451,056 A 9/1995 Manning
5,460,376 A 10/1995 Schmidt et al.
5,467,983 A 11/1995 Chen
5,470,069 A 11/1995 Schmidt et al.
5,474,296 A 12/1995 Schmidt et al.
5,482,279 A 1/1996 Antonious
5,497,993 A 3/1996 Shan
5,505,453 A 4/1996 Mack
5,522,593 A 6/1996 Kobayashi et al.
5,524,331 A 6/1996 Pond
5,533,729 A 7/1996 Leu
5,536,006 A 7/1996 Shieh
5,547,630 A 8/1996 Schmidt
5,549,297 A 8/1996 Mahaffey
5,564,994 A 10/1996 Chang
5,584,770 A 12/1996 Jensen
5,595,552 A 1/1997 Wright et al.
5,611,741 A 3/1997 Schmidt et al.
5,611,742 A 3/1997 Kobayashi
D379,393 S 5/1997 Kubica
5,626,530 A 5/1997 Schmidt et al.
5,643,104 A 7/1997 Antonious
5,643,108 A 7/1997 Cheng
5,643,110 A 7/1997 Igarashi
5,649,872 A 7/1997 Antonious
5,651,409 A 7/1997 Sheehan
5,655,976 A 8/1997 Rife
5,669,827 A 9/1997 Nagamoto
5,669,829 A 9/1997 Lin
5,674,132 A 10/1997 Fisher
D387,113 S 12/1997 Burrows
5,695,411 A 12/1997 Wright et al.
5,709,614 A 1/1998 Horiba
5,709,615 A 1/1998 Liang
5,711,722 A 1/1998 Miyajima et al.
5,716,292 A 2/1998 Huang
5,718,641 A 2/1998 Lin
5,720,673 A 2/1998 Anderson
5,743,813 A 4/1998 Chen et al.
5,753,170 A 5/1998 Muang
5,755,624 A 5/1998 Helmstetter
5,762,567 A 6/1998 Antonious
5,766,092 A 6/1998 Mimeur et al.
5,766,094 A 6/1998 Mahaffey et al.
5,766,095 A 6/1998 Antonious

(56) References Cited

U.S. PATENT DOCUMENTS 5,776,011 A 7/1998 Su et al.
5,807,190 A 9/1998 Krumme et al.
5,827,132 A 10/1998 Bamber
RE35,955 E 11/1998 Lu
D401,652 S 11/1998 Burrows
5,830,084 A 11/1998 Kosmatka
5,839,975 A 11/1998 Lundberg
5,842,934 A 12/1998 Ezaki et al.
5,851,159 A 12/1998 Burrows
5,863,261 A 1/1999 Eggiman
5,873,791 A 2/1999 Allen
5,873,795 A 2/1999 Wozny et al.
D406,294 S 3/1999 Burrows
5,888,148 A 3/1999 Allen
5,890,973 A 4/1999 Gamble
5,896,642 A 4/1999 Peker et al.
D411,272 S 6/1999 Burrows
5,908,357 A 6/1999 Hsieh
5,921,872 A 7/1999 Kobayashi
5,931,746 A 8/1999 Soong
5,935,019 A 8/1999 Yamamoto
5,938,541 A 8/1999 Allen et al.
5,941,782 A 8/1999 Cook
5,944,619 A 8/1999 Cameron
5,954,596 A 9/1999 Noble et al.
D415,807 S 10/1999 Werner et al.
5,961,394 A 10/1999 Minabe
5,967,905 A 10/1999 Nakahara et al.
5,971,868 A 10/1999 Kosmatka
5,993,329 A 11/1999 Shieh
6,001,495 A * 12/1999 Bristow ..... A63B 53/04 420/418
6,007,432 A 12/1999 Kosmatka
6,017,280 A * 1/2000 Hubert ..... A63B 53/04 473/324
6,027,416 A 2/2000 Schmidt et al.
6,139,445 A 10/2000 Werner et al.
6,152,833 A 11/2000 Werner et al.
6,200,685 B1 * 3/2001 Davidson ..... A61F 2/30767 148/317
6,248,025 B1 6/2001 Murphy et al.
6,319,150 B1 11/2001 Werner et al.
6,338,683 B1 1/2002 Kosmatka
6,354,962 B1 * 3/2002 Galloway ..... A63B 53/02 473/342
6,381,828 B1 5/2002 Boyce et al.
6,390,933 B1 5/2002 Galloway et al.
6,398,666 B1 6/2002 Evans et al.
6,413,169 B1 7/2002 Kosmatka
6,435,982 B1 8/2002 Galloway et al.
6,565,452 B2 5/2003 Helmstetter et al.
6,605,007 B1 8/2003 Bissonnette et al.
6,607,693 B1 * 8/2003 Saito ..... C22C 1/045 148/421
6,623,376 B2 * 9/2003 Poynor ..... A63B 53/0466 148/516
6,663,501 B2 12/2003 Chen
6,755,627 B2 6/2004 Chang
6,800,243 B2 * 10/2004 Tetyukhin ..... C22F 1/183 148/421
6,913,546 B2 * 7/2005 Kakiuchi ..... A63B 53/0466 473/345
6,932,716 B2 * 8/2005 Ehlers ..... A63B 53/04 473/329
6,994,635 B2 2/2006 Poynor
7,029,403 B2 4/2006 Rice et al.
7,066,832 B2 6/2006 Willett et al.
7,096,558 B2 8/2006 Sano
7,207,898 B2 4/2007 Rice et al.
7,261,643 B2 8/2007 Rice et al.
7,281,985 B2 * 10/2007 Galloway ..... A63B 53/02 473/246
7,361,099 B2 4/2008 Rice et al.
7,621,824 B2 * 11/2009 Sano ..... A63B 53/0466 473/314
7,878,925 B2 * 2/2011 Ogawa ..... A63B 53/0466 473/342
8,047,931 B2 11/2011 Yokota
8,409,032 B2 * 4/2013 Myrhum ..... A63B 53/0466 473/342
9,433,835 B2 * 9/2016 Sugimae ..... A63B 53/04
2001/0000337 A1 * 4/2001 Naruo ..... A63B 53/04 473/324
2001/0001773 A1 * 5/2001 Naruo ..... A63B 53/04 473/324
2005/0020379 A1 * 1/2005 Kumamoto ..... A63B 53/04 473/332
2005/0026723 A1 * 2/2005 Kumamoto ..... A63B 53/04 473/345
2005/0072496 A1 * 4/2005 Hwang ..... C22F 1/183 148/421
2005/0192117 A1 * 9/2005 Knuth ..... A63B 53/0466 473/342
2005/0221913 A1 * 10/2005 Kusumoto ..... A63B 53/0466 473/345
2006/0189410 A1 * 8/2006 Soracco ..... A63B 60/42 473/342
2008/0090676 A1 * 4/2008 Matsunaga ..... A63B 53/0466 473/350
2013/0310192 A1 * 11/2013 Wahl ..... C25D 1/00 473/331
2013/0324301 A1 * 12/2013 Boyd ..... A63B 53/04 473/342
2014/0080633 A1 * 3/2014 Bezilla ..... A63B 53/06 473/342
2014/0295988 A1 10/2014 Sugimae et al.

FOREIGN PATENT DOCUMENTS

GB 2331938 A 6/1999
JP 59207169 11/1984
JP 61033682 2/1986
JP 61162967 7/1986
JP 61181477 8/1986
JP 61185281 8/1986
JP 61240977 10/1986
JP 1244770 9/1989
JP 02130519 5/1990
JP 4020357 1/1992
JP 4327864 11/1992
JP 5212526 8/1993
JP 05237207 9/1993
JP 6007487 1/1994
JP 06031016 2/1994
JP 6114126 4/1994
JP 6126002 5/1994
JP 6154367 6/1994
JP 6182005 7/1994
JP 6269518 9/1994
JP 8168541 7/1996
JP 08224327 9/1996
JP 08224327 A * 9/1996
JP 8243194 9/1996
JP 8280853 10/1996
JP 8280854 10/1996
JP 8294550 11/1996
JP 9028842 2/1997
JP 9047531 2/1997
JP 9154985 6/1997
JP 9168613 6/1997
JP 9192270 7/1997
JP 9192273 7/1997
JP 9239074 9/1997
JP 9239075 9/1997
JP 9248353 9/1997
JP 9294833 11/1997
JP 9299519 11/1997
JP 10024126 1/1998
JP 10024128 1/1998
JP 10085369 4/1998

(56) References Cited

FOREIGN PATENT DOCUMENTS

| | | | |
|---|---|---|---|
| JP | 10118227 | | 5/1998 |
| JP | 10137372 | | 5/1998 |
| JP | 10155943 | | 6/1998 |
| JP | 10258142 | | 9/1998 |
| JP | 10263121 | | 10/1998 |
| JP | 10323410 | | 12/1998 |
| JP | 10337347 | | 12/1998 |
| JP | 2010-100943 | | 5/2010 |
| JP | 2010100943 | A * | 5/2010 |

OTHER PUBLICATIONS

Golf Digest, Dec. 1981, p. 58 59.
"Variable Face Thickness Technology," Calloway Golf advertisement, cover and pp. 1-4, undated.
"Advantages of High-Formability SP-700 Titanium Alloy and Its Applications," JFE Report GIHO, Aug. 2004, No. 5, pp. 63-64.
"Elastic Modulus Measurement," Olympus Corporation, 2013, pp. 1-4.

* cited by examiner

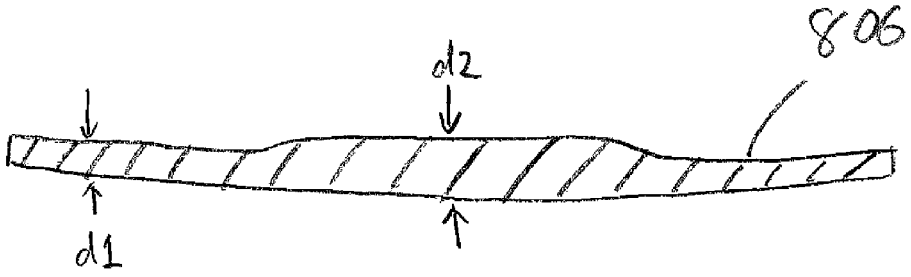
FIG. 8b
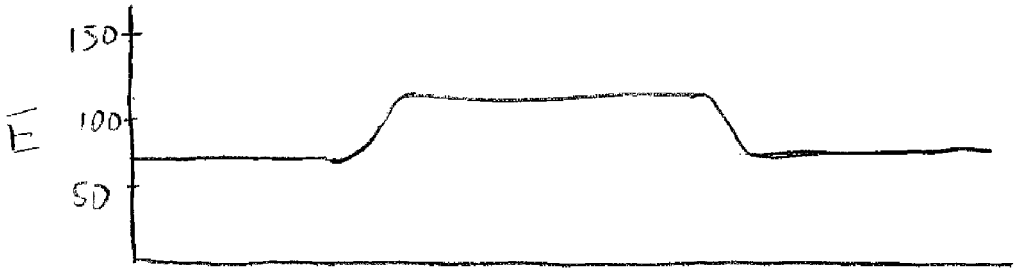
FIG 8C
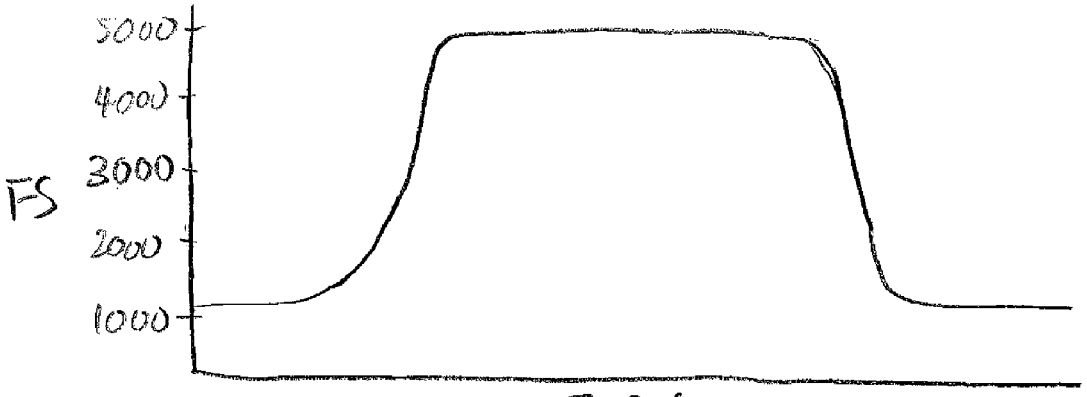
FI8. 8D

GOLF CLUB HEAD WITH IMPROVED STRIKING FACE

CROSS-REFERENCE TO RELATED APPLICATIONS

This application is a Continuation of U.S. patent application Ser. No. 13/854,817, filed Apr. 1, 2013, the disclosure of which is incorporated by reference in its entirety.

FIELD OF THE INVENTION

The present invention relates generally to a golf club head with an improved striking face. More specifically, the present invention relates to a striking face of a golf club head manufactured utilizing an innovative quenching method that alters the Young's modulus of the material. The striking face portion in accordance with the present invention is generally created from an beta rich, near beta $\alpha+\beta$ titanium alloy such as SP 700 that will yield a reduced Young's modulus of the material to improve the performance of the striking face. The present invention could even create a change in the Young's modulus of the striking face while maintain the same alloy to further improve the performance of the striking face.

BACKGROUND OF THE INVENTION

In order to improve the performance of a golf club, club designers are constantly struggling to achieve a golf club with higher performance. One of the recent trends in improving golf club performance has been focused on improving the striking face of a metalwood golf club head.

The striking face of a metalwood golf club head is one of the most important component of a golf club head, as it is the only part that comes in contact with the golf ball. In order to maximize the performance of a golf club head, golf club designers have experimented with variables such as improving the coefficient of restitution (COR) as well as increasing the size of the "sweet zone". The "sweet zone", as generally known in the golf industry, relates to the zone of substantially uniform high initial velocity or a high COR. These concepts of "sweet zone" and COR have already been discussed by U.S. Pat. No. 6,605,007 to Bissonnette et al., and the disclosure of which is hereby incorporated by reference in its entirety.

One of the ways to create a larger "sweet zone" is illustrated in U.S. Pat. No. 8,318,300 to Schmitt et al., wherein a frontal wall of the striking face has a variable thickness. More specifically, U.S. Pat. No. 8,318,300 discussed how a golf club having a variable thickness will resist cracking bucking, and to efficiently transmit impact forces to the head top wall.

U.S. Pat. No. 7,682,262 to Soracco et al. expands upon the above basic concept of a variable face thickness by going on to establish the concept of "flexural stiffness", wherein different flexural stiffness in the striking face can be achieved by different materials, different thicknesses, or a combination of both different material and different thicknesses.

Despite all of the advances in attempting to improve the performance of the striking face of the golf club head, none of the references are capable of adjusting the performance of the striking face without varying the material or thickness, both of which have some minor drawbacks. Varying the material of the striking face would require a bonding process to occur at the striking face portion, which could potentially crack when subjected to the high impact forced with a golf ball. Varying the thickness of the striking face, although eliminates the problem with cracking, would require additional mass at the striking face portion by thickening up certain parts of the striking face.

More importantly, none of the prior art recognize the ability to alter the Young's modulus of the same material used for the striking face portion to improve upon the performance of the golf club head.

Hence, based on the above it can be seen, there exists a need for an ability to alter the performance of a striking face of a golf club head that takes advantage of the inherent material property of the material by altering its Young's modulus. More specifically, there is a need in the field for a striking face of a golf club head wherein the Young's modulus of the striking face could be changed independent or in combination with the adjustment in altering the thickness.

BRIEF SUMMARY OF THE INVENTION

In one aspect of the present invention is a golf club head comprising of a striking face portion and an aft portion attached to the rear of the striking face portion. The striking face portion is made out of an $\alpha-\beta$ titanium having a Molybdenum Equivalency between 4.0 and 9.75 and wherein at least a portion of the striking face portion has a Young's modulus of less than about 90 GPa.

In another aspect of the present invention is a method of manufacturing a golf club head comprising the step of heating a striking face portion that is made of an $\alpha-\beta$ titanium alloy to a temperature that is 25-100° C. below a $\beta$-transus temperature of a material used to make said striking face portion and subsequently quenching the striking face portion using a die via conduction by maintaining the die in direct contact with the striking face portion for greater than about 15 seconds. The resulting face insert portion will comprise of at least one phase that is a body centered cubic $\beta$ structure and where at least a portion of the striking face portion has a Young's modulus of less than about 90 GPa.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

FIG. 3*c* shows the Flexural Stiffness profile of the prior art face insert across cross-sectional area shown in FIG. 3*b;*

FIG. 8*a* shows a perspective view of a face insert with a die in accordance with an exemplary embodiment of the present invention;

FIG. 8*b* shows a cross-sectional view of the face insert shown in FIG. 8*a;*

FIG. 8*c* shows the Young's modulus profile of the face insert across the cross-sectional area shown in FIG. 8*b;*

FIG. 8D shows the Flexural Stiffness profile of the face insert across cross-sectional area shown in FIG. 8*b;*

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
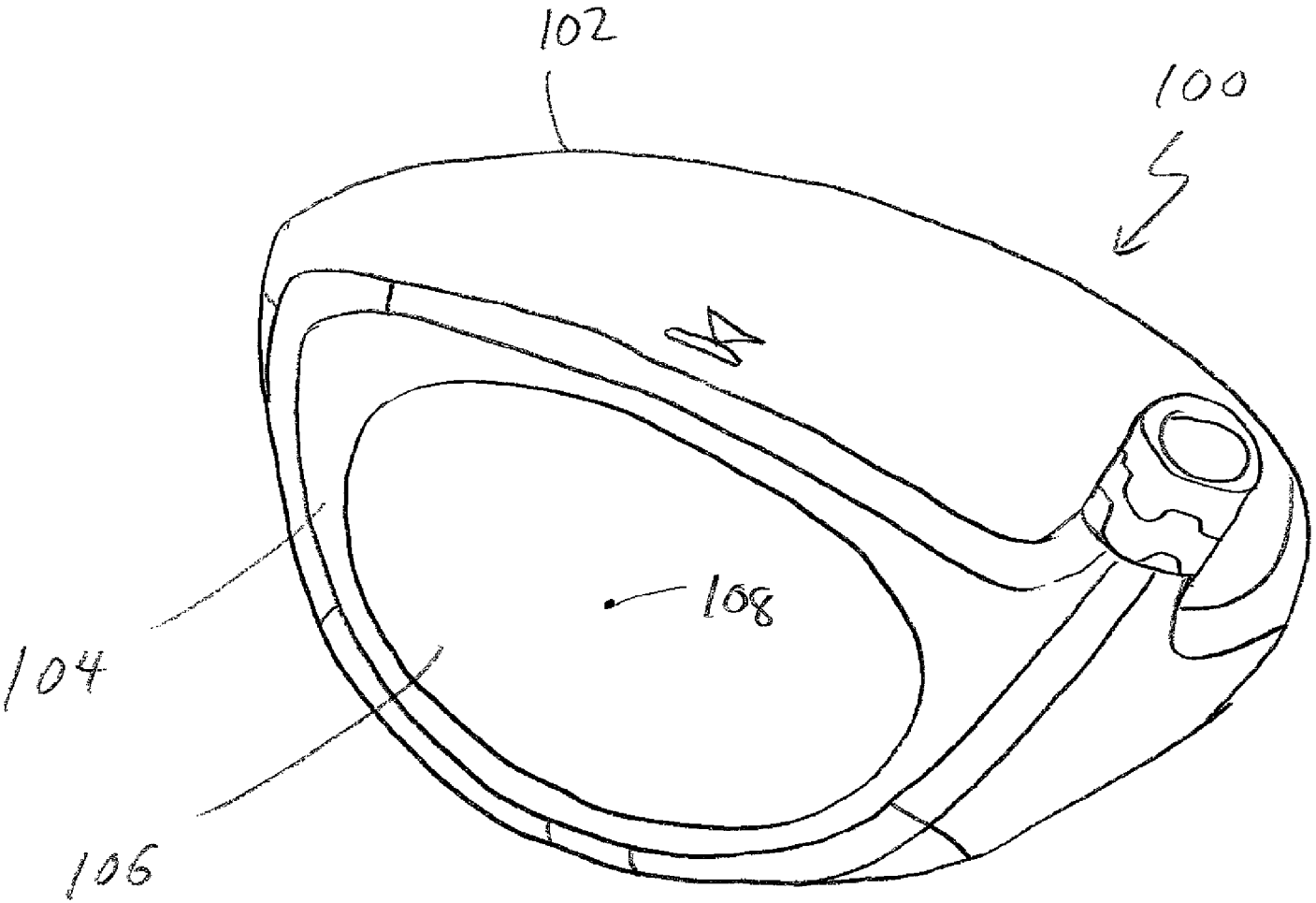
FIG. 1 shows a perspective view of a golf club head in accordance with the present invention.

FIG. 1 of the accompanying drawings shows a perspective view of a golf club head 100 in accordance with the present invention. The golf club head 100 may generally have a body 102 portion and a striking face 104 portion, wherein the striking face 104 may further comprise of a face insert 106. The face insert 106 of the golf club head 100 may generally have a variable Young's modulus changing radially from the center 108 of the striking face 104. In an alternative embodiment of the present invention, the striking face 104 may utilize a face cup construction instead of a face insert 106 while still maintaining a variable Young's modulus that changes radially from the center 108 of the striking face.

The face insert 106 of the striking face 104, as discussed in this exemplary embodiment, may generally be comprised of a β rich α+β titanium material such as SP-700. A β rich titanium material is preferred because the change in Young's modulus of the face insert 106 contemplated by the present invention is achieved through the phase changes of the titanium between α and β phases via a heat treatment and quenching process. More information regarding the preferred material of SP-700 can be found in JFE's technical report titled *Advantages of High Formability SP* 700 *Titanium Alloy and Its Applications* (March 2005), the disclosure of which is incorporated by reference in its entirety. However, there are numerous other alloys that could potentially exhibit such a behavior which can generally be described as being near β titanium alloys. The nomenclature of titanium alloys as α or β is based on which phase is predominantly present in the alloy at room temperature. As can be expected an a titanium alloy has predominantly α phase present at room temperature. Conversely, a β alloy has predominantly β phase present at room temperature. And a α–β alloy has both phases present in significant quantities. It should be pointed out that for most titanium alloys of importance, β phase is not the equilibrium phase at room temperature as per the thermodynamic principles; it is infact α phase. The reason β phase remains at room temperature is because the transformation of β to α is suppressed due to rapid cooling or quenching. Certain elements such as Mo, V, Cr, Fe, Ni, Co, Mn, Nb, Ta and W tend to stabilize the β phase and therefore alloying of titanium with such elements allows the alloy to be cooled slowly while still retaining β phase. When a titanium alloy containing significant amount of β phase is heated to elevated temperature, the β phase transforms into the equilibrium α phase. Thus the β phase in most titanium alloys is considered as metastable. It is possible to alloy the titanium to such an extent, that the β phase becomes the equilibrium phase and such an alloy cannot be heated to elevated temperature to transform into α. Alloys belonging to this category are not part of this invention. The discussion above relating to the transformation and stability of β phase can be described by a parameter called "Molybdenum Equivalency" summarized by Eq. (1) below $$\text{Mo-Eq}=\%\ \text{Mo}+0.2\%\ \text{Ta}+0.28\%\ \text{Nb}+0.4\%\ \text{W}+0.67\%\ \text{V}+1.25\%\ \text{Cr}+1.25\%\ \text{Ni}+1.7\%\ \text{Mn}+1.7\%\ \text{Co}+2.5\%\ \text{Fe} \quad \text{Eq. (1)}$$

where % indicates the weight percent of that element in the alloy.

A Mo-Eq greater than about 10 is considered necessary for retaining all the β phase at room temperature. A titanium alloy is considered near β alloy when the Mo-Eq. is close to 10 but not more than 10, although a clear definition of near β titanium alloy is not available, for the purpose of this discussion, a Mo-Eq of greater than about 10 can be considered a β rich alloy. For this invention it is speculated that alloys having Mo-Eq in the range 4-9.5 are suitable for die quenching to obtain the low Young's modulus discussed above. It should be pointed out that Young's modulus will depend on the alloying element and not strictly on the Mo-Eq. For example, it is possible to achieve a Mo-Eq. of 9 by alloying titanium with 9 wt % of Mo or 3.6 wt % of Fe. The resulting Young's modulus however is not the same for both alloys.

The Young's modulus of the face insert 106 that changes radially from the center may not does not require the Young's modulus of the face insert 106 to be different at each and every section that shifts away from the center 108 of the striking face 104. Rather, the radial change in Young's modulus, as referred to by the present invention, could alternatively be described as a mere change of the Young's modulus of the face insert 106 at different locations. The face insert 106, as described in the present embodiment, may generally be comprised of a single alloy such as SP-700 Titanium as described above, however, other alloys capable of α and β phase transformation may also be used without departing from the scope and content of the present invention.

Figure 2:
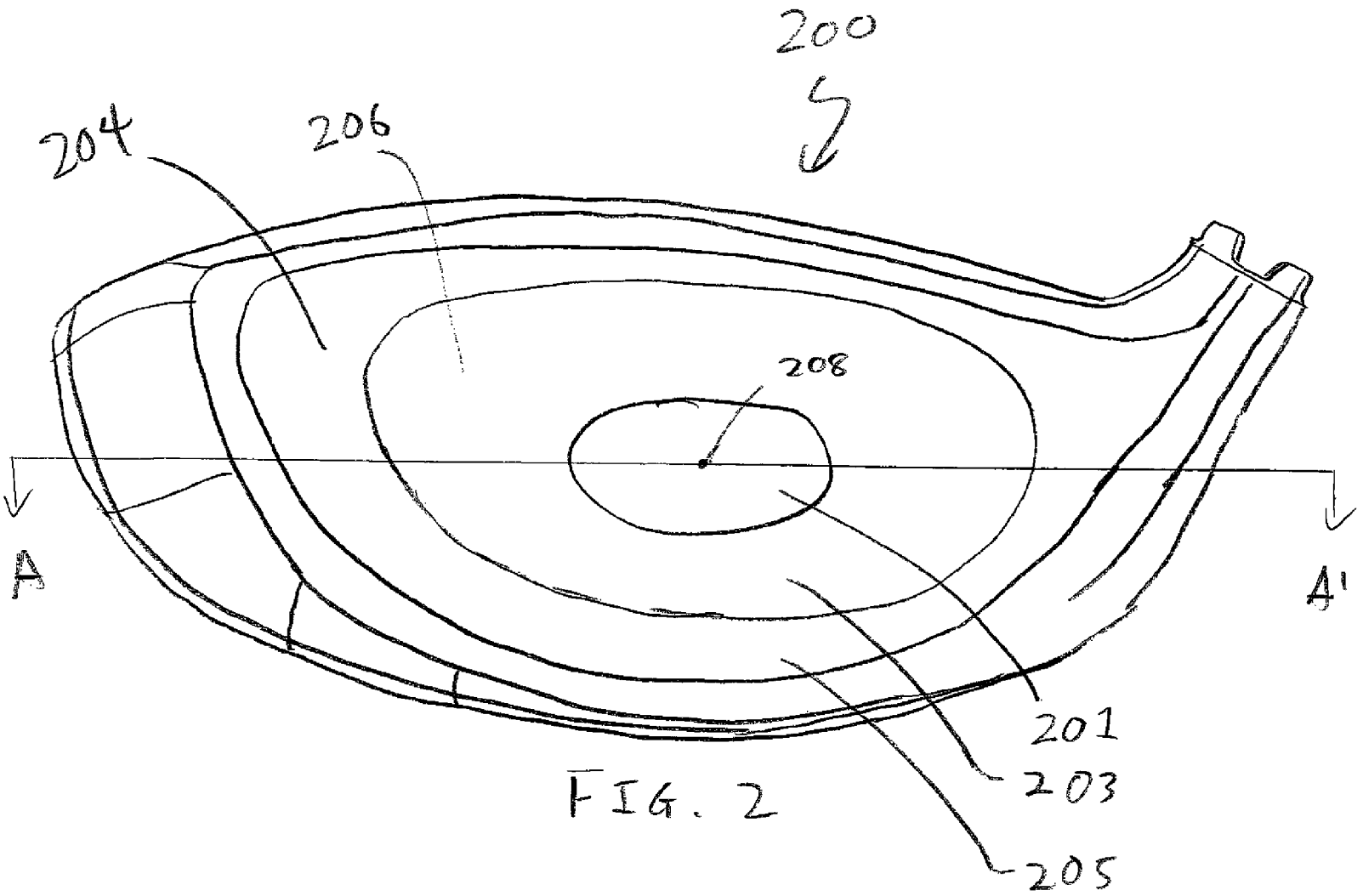
FIG. 2 shows a frontal view of a golf club head in accordance with the present invention, allowing cross-sectional line A-A' to be shown.

FIG. 2 of the accompanying drawings shows a frontal view of a golf club head 200 in accordance with the present invention, allowing cross-sectional line A-A' to be shown. FIG. 2, in addition to showing the striking face 204 with a face insert 206, also show a central zone 201, an intermediate zone 203, and an outer zone 205. The location and size of the central zone 201, the intermediate zone 203, and outer zone 205 shown here in FIG. 2 are not critical and are not drawn to scale. The illustration here serves the purpose of illustrating the relationship of the zones relative to one another, as the zones will be referred to later with respect to the varying Young's modulus of the striking face 204.

Figure 3A:
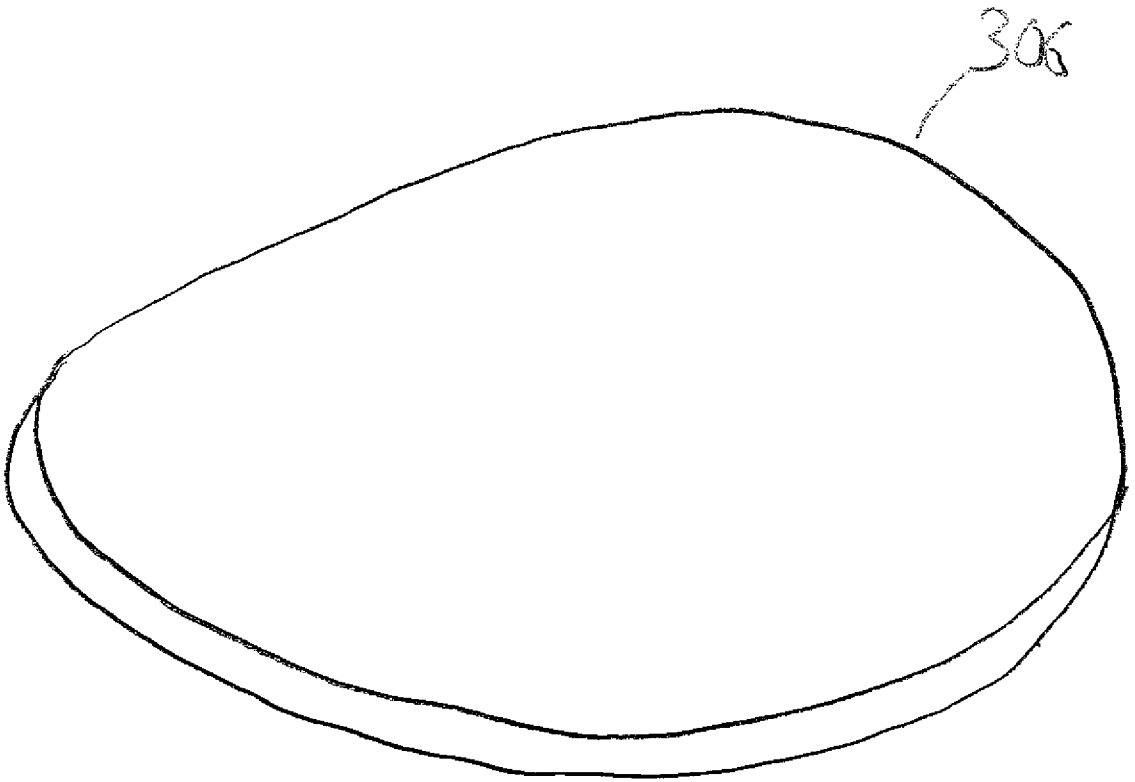
FIG. 3a (Prior Art)
FIG. 3*a* shows a perspective view of prior art face insert.
Figure 3B:
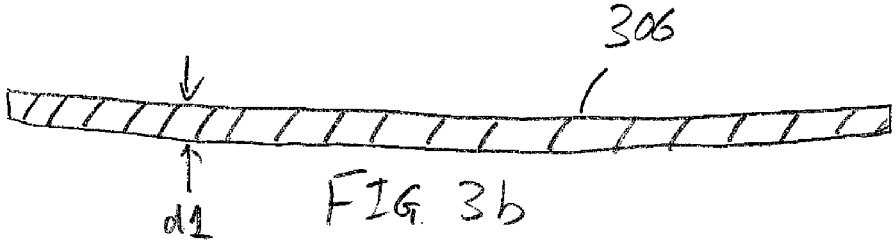
FIG. 3b (Prior Art)
FIG. 3*b* shows a cross-sectional view of the prior art face insert shown in FIG. 3*a;*
Figure 3C:
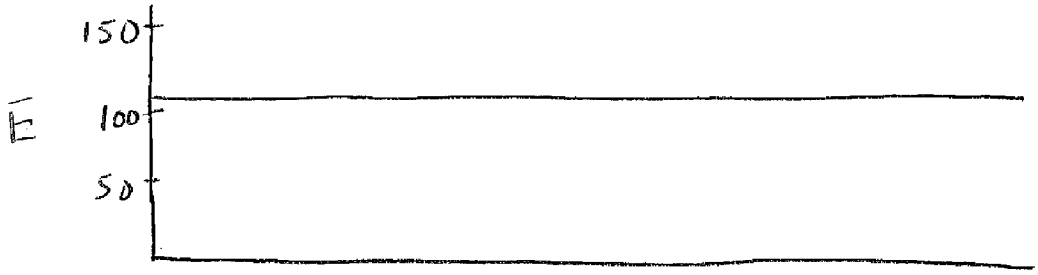
FIG. 3c (Prior Art)
FIG. 3*c* shows the Young's modulus profile of the prior art face insert across the cross-sectional area shown in FIG. 3*b;*
Figure 3D:
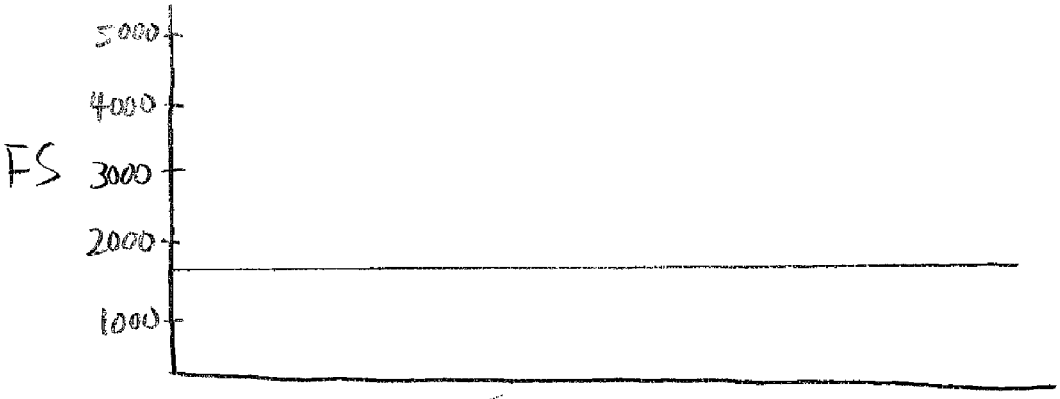
FIG. 3d (Prior Art)
FIG. 3*d* shows the Flexural Stiffness profile of the prior art face insert across cross-sectional area shown in FIG. 3*b;*

In order to understand the need for a striking face 204 of a golf club head to have a varying Young's modulus that changes radially from the central zone 201, the intermediate zone 203, and the outer zone 205, a brief background discussion regarding the development of prior art striking face of a golf club may be beneficial. FIGS. 3*a*, 3*b*, 3*c*, and 3*d* of the accompanying drawings does that by showing a prior art face insert 306 together with its Young's modulus and Flexural Stiffness (FS) profiles across a horizontal cross-section. FIG. 3*a* of the accompanying drawings shows a perspective view of a face insert 306 in accordance with a prior art golf club head with a constant thickness across the entire face insert 306. FIG. 3*b* shows a cross-sectional view of a face insert 306 taken horizontally from a heel to toe direction of the striking face 204 passing through the face center 208 as illustrated by cross-sectional line A-A' shown in FIG. 2. As previously mentioned, the thickness of the face insert 306 in this prior art embodiment may generally have a constant thickness d1 of about 2.5 mm. Because it is desirable for the face insert 306 of a striking face to be flexible to increase the coefficient of restitution upon impact with a golf ball, it is generally desirable to have a face with a low Young's modulus with a high tensile strength paired with a low yield strength. FIG. 3*c* shows the Young's modulus of this prior art face insert 306 being constant at approximately 110 GPa across the entire width of the face insert 306. Finally, FIG. 3*d* of the accompanying drawing shows a graph of the Flexural Stiffness of the face insert 306 across the cross-section shown in FIG. 3*b*. The concept of flexural stiffness is defined by the following formula as shown by Eq. (2):

$$FS=E*t^3 \quad \text{Eq. (2)}$$

where,

E=Young's modulus of material, and t=thickness of the material.

The concept of determining the Flexural Stiffness of a striking face of a golf club has been discussed in commonly owned U.S. Pat. No. 6,605,007 to Bissonnette et al., the disclosure of which is incorporated by reference in its entirety.

Before the discussion moves away from the Young's modulus of a material, it is worthwhile to note here that the Young's modulus of a material such as a striking face of a golf club head may generally be measured using a non-destructive ultrasonic test equipment, as the Young's modulus of a material is related to its Poisson's Ratio, which is a function of the longitudinal and shear wave sound velocity. Numerous devices such as the Olympus Thickness Gauges 38DL Plus, 45MG with Single Element Software, or Model 35 DL can all be used. Alternatively, Olympus Flaw Detectors with velocity measurement capabilities such as the EPOCH series instruments or even Olympus Pulse/Receivers such as Model 5072PR or 5077PR can all be used without departing from the scope and content of the present invention.

Here, given that the Young's modulus of the face insert 306 is approximately 110 GPa and the thickness d1 of the face insert is about 2.5 mm, the Flexural Stiffness of this prior art face insert stay constant at approximately 1,700 kN-mm.

One factor useful to determine the ability of the face insert 306 to improve the coefficient of restitution over a greater area is to calculate the Flexural Stiffness Ratio of a the face insert 306, wherein the Flexural Stiffness Ratio is defined as follows by Eq. (3):

$$\text{Flexural Stiffness Ratio} = \frac{\text{Peak Flexural Stiffness}}{\text{Trough Flexural Stiffness}} \quad \text{(Eq. 3)}$$

Here, in this prior art embodiment, the Flexural Stiffness Ratio is 1, as the Flexural Stiffness of the entire prior art face insert 306 stays constant across the entire cross-section.

Figure 4A:
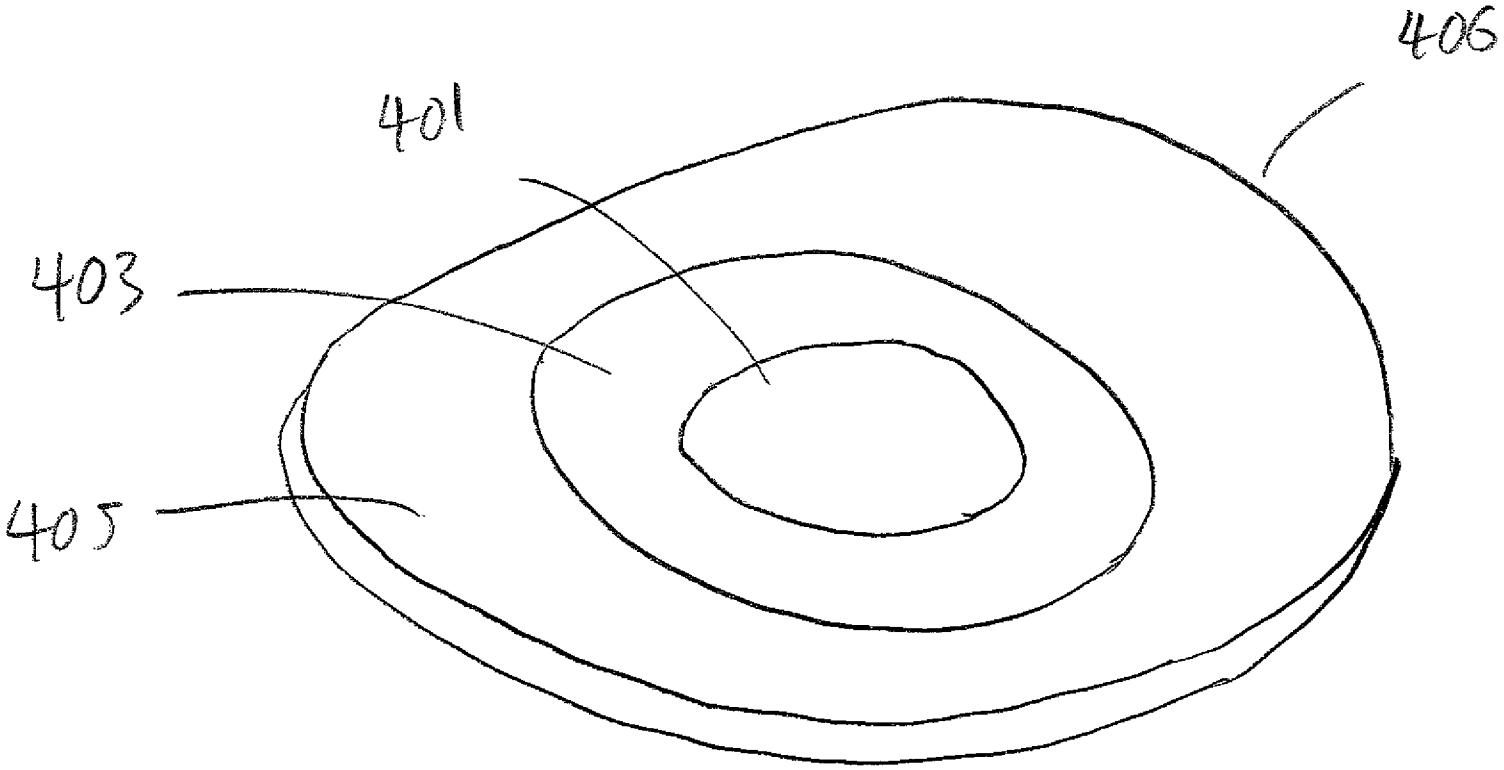
FIG. 4a (Prior Art)
FIG. 4*a* shows a perspective view of a different prior art face insert.
Figure 4B:
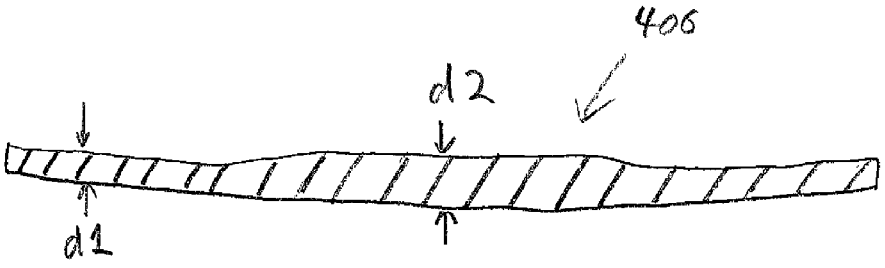
FIG 4b (Prior Art)
FIG. 4*b* shows a cross-sectional view of the prior art face insert shown in FIG. 4*a;*
Figure 4C:
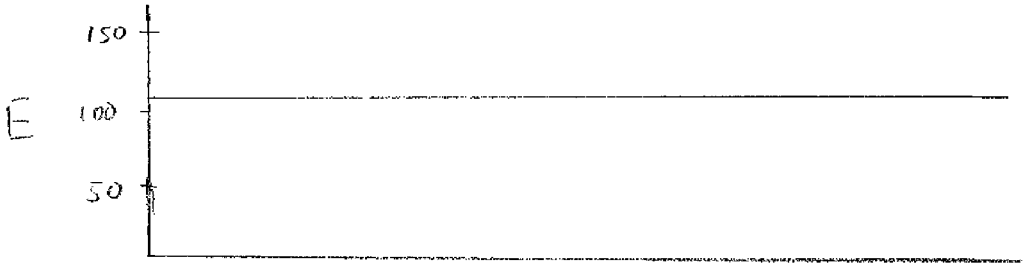
FIG 4c (Prior Art)
FIG. 4*c* shows the Young's modulus profile of the prior art face insert across the cross-sectional area shown in FIG. 4.
Figure 4D:
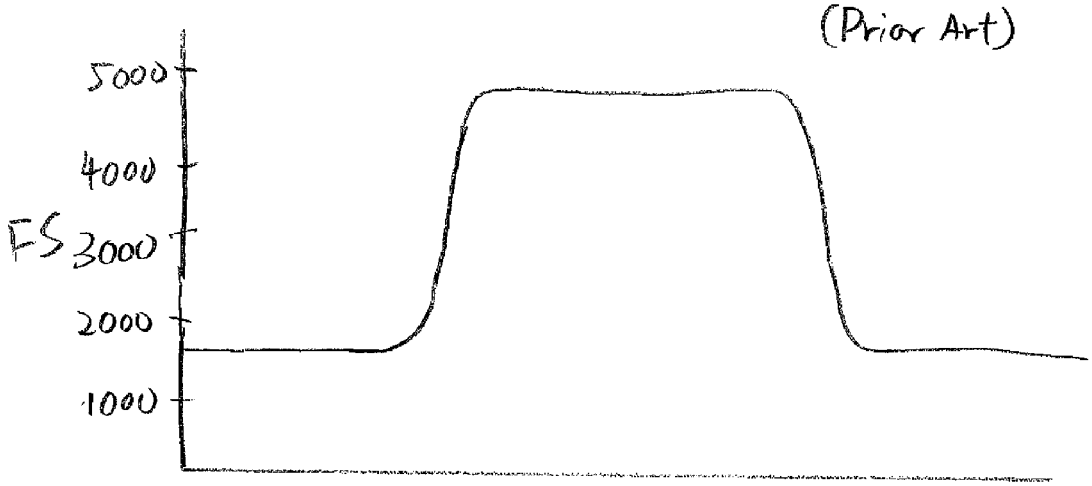
FIG. 4d (Prior Art)
FIG. 4*d* shows the Flexural Stiffness profile of the prior art face insert across cross-sectional area shown in FIG. 4*b;*

FIG. 4*a* through 4*d* of the accompanying drawings shows a different prior art face insert 406 intended to improve upon the prior art face insert 306 shown in FIG. 3, by creating a face insert 406 with a variable Flexural Stiffness. This prior art face insert 406 achieves this change in Flexural Stiffness by utilizing the commonly known technique of varying the thickness of the face insert 406. In FIG. 4*b*, the cross-sectional view of the face insert 406 is taken horizontally across the striking face, as indicated by cross-sectional line A-A' shown in FIG. 2 is shown to more fully illustrate the change in thickness of the face insert 406. Here, the face insert 406 is thicker at the central zone and thinner around the intermediate and outer zones. More specifically, the outer zone may have a first thickness d1 of approximately 2.5 mm, while the central zone may have a second thickness d2 of approximately 3.5 mm. FIG. 4*c* shows that this prior art face insert 406 has a constant Young's modulus of approximately 110 GPa across the entire cross-section, yielding a Flexural Stiffness profile shown in FIG. 4*d*. The Flexural Stiffness profile of the variable thickness face insert 406 shown in FIG. 4*d* may have a Flexural Stiffness of approximately 1,700 kN-mm at the outer zones and gradually increasing to a Flexural Stiffness of about 4,700 kN-mm at the central zone, before tapering back to a Flexural Stiffness of approximately 1,700 kN-mm at the other outer zone. It is worth noting that in this exemplary embodiment, the change in the Flexural Stiffness of the prior art face insert 406 is achieved by changing the thickness "t" while keeping the Young's modulus of the material constant.

This prior art face insert 406, by incorporating a variable face thickness, has a Flexural Stiffness Ratio of 2.75, indicative of the fact that the central zone 401 is approximately 2.75 more compliant than the outer zone 405, as the peak Flexural Stiffness and the trough Flexural Stiffness occur at the central zone 401 and outer zone 405 respectively.

FIG. 5*a* through 5*d* shows a face insert 506 in accordance with an exemplary embodiment of the present invention with a die 510 used to help rapidly quench and cool the face insert 506 to promote the phase transformation of the face insert 506 discussed above. Although the conventional quenching process of a face insert 506 may generally be convection cooling with air, the current embodiment utilizes conduction cooling by placing the die 510 in direct contact with the face insert 506 to achieve the rapid quenching required. The phase transformation of this particular titanium material serves to retain the β phase titanium post heat treatment, which alter the Young's modulus of the material. In the exemplary embodiment, a face insert 506 of a golf club head's striking face is generally heat treated by first bring the temperature of the face insert above a β transus temperature and selectively quenching all or just a portion of the face insert 506 to preserve the β titanium body-centered cubic crystalline structure. The result of the present inventive methodology allows a phase change in the titanium material, thus lowering the Young's modulus of the material.

In one preferred embodiment, the SP-700 titanium face insert 506 may generally be heated 50 C. below the β transus temperature to about 845° C. for a time period of 6 minutes. Subsequent to the heating phase, the die 510 is introduced to the face insert 506 for a duration of greater than approximately 5 seconds, more preferably greater than about 10 seconds, most preferably greater than about 15 seconds. This die 510 may generally have an internal geometry the mirrors the ultimate geometry of the face insert 506, as the die 510 can also help form the geometry of the face insert 506 by applying pressure to the face insert 506 similar to that of a forging process. In this exemplary embodiment of the present invention, the temperature of the die 510 is not controlled, however, in a more precise embodiment, the temperature of the die 510 could be maintained at a desired temperature without departing from the scope and content of the present invention. For example, in an alternative embodiment of the present invention, the face insert 506 could be heated up to the previously discussed temperature of about 845° C., then quenched by a die 510 that is maintained at a temperature of less than about 250° C., more preferably less than about 200° C., and most preferably less than about 150° C. without departing from the scope and content of the present invention.

The die 510 shown in this exemplary embodiment of the present invention may generally be created from a carbon steel type material with a bulk conductivity of approximately 16 W/mK to allow heat of the face insert 506 to be conducted away to the die 510. However, numerous other materials such as iron with a bulk conductivity of approximately 55 W/mK, Zinc with a bulk conductivity of approximately 112 W/mK, aluminum with a bulk conductivity of approximately 167 W/mK, copper with a bulk conductivity of approximately 388 W/mK, or even silver with a bulk conductivity of approximately 418 W/mK all without departing from the scope and content of the present invention. In fact. The material of the die 510 may generally have a bulk conductivity of greater than about 10 W/mK, more preferably greater than about 15 W/mK, and most preferably greater than about 20 w/mK.

Figure 5A:
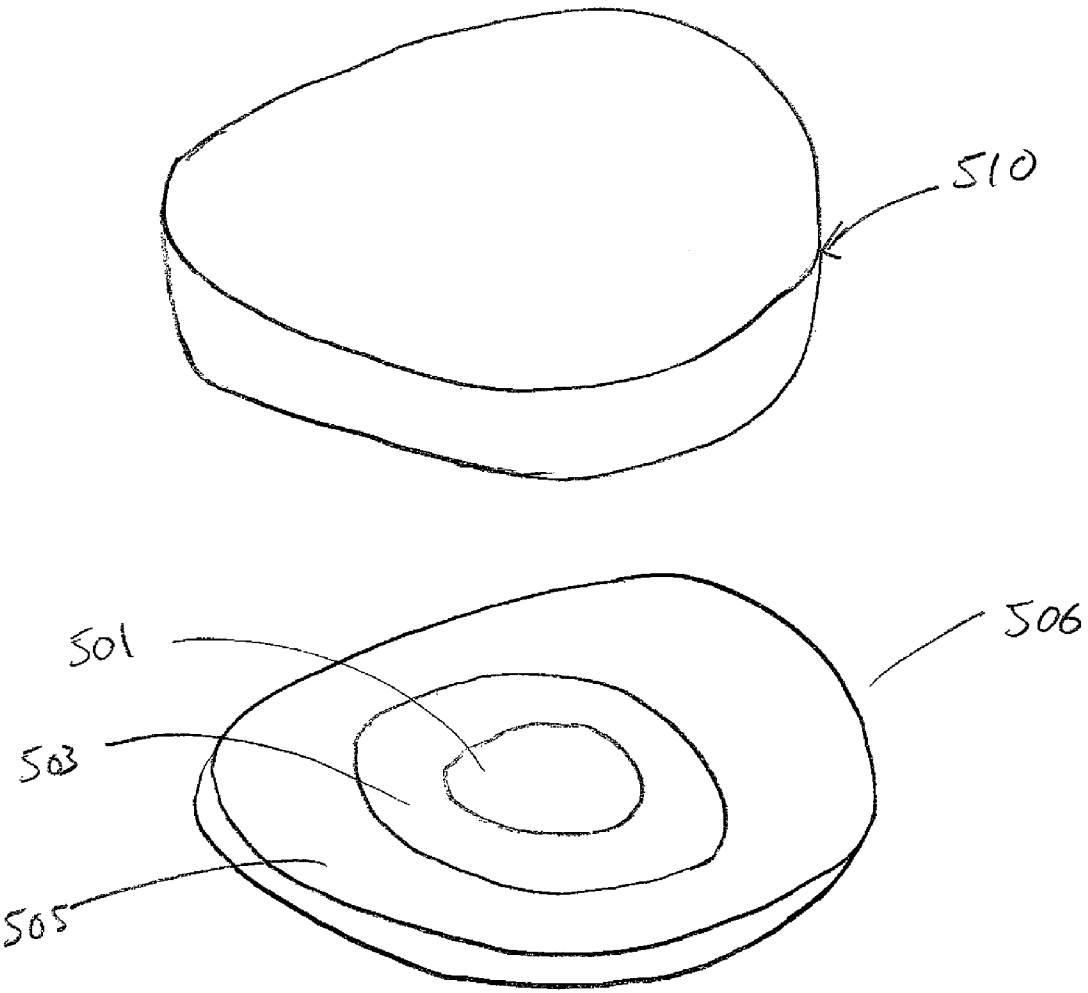
FIG. 5*a* shows a perspective view of a face insert with a die in accordance with an exemplary embodiment of the present invention.
Figure 5B:
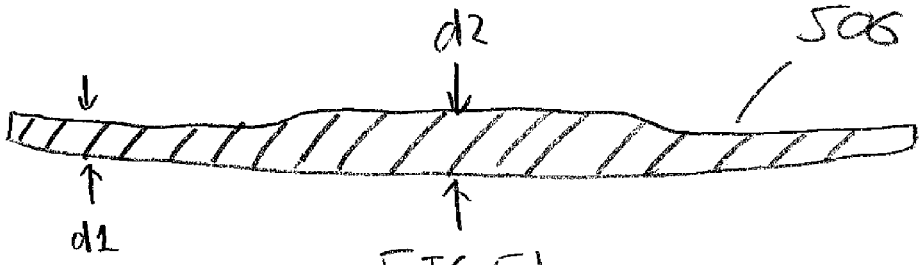
FIG. 5*b* shows a cross-sectional view of the face insert shown in FIG. 5*a;*
Figure 5C:
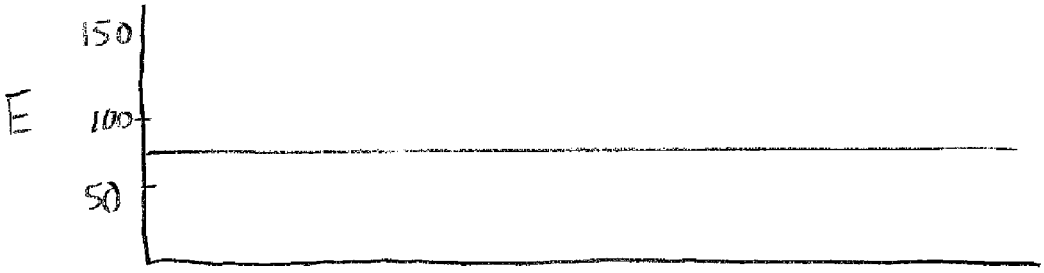
FIG. 5*c* shows the Young's modulus profile of the face insert across the cross-sectional area shown in FIG. 5*b;*
Figure 5D:
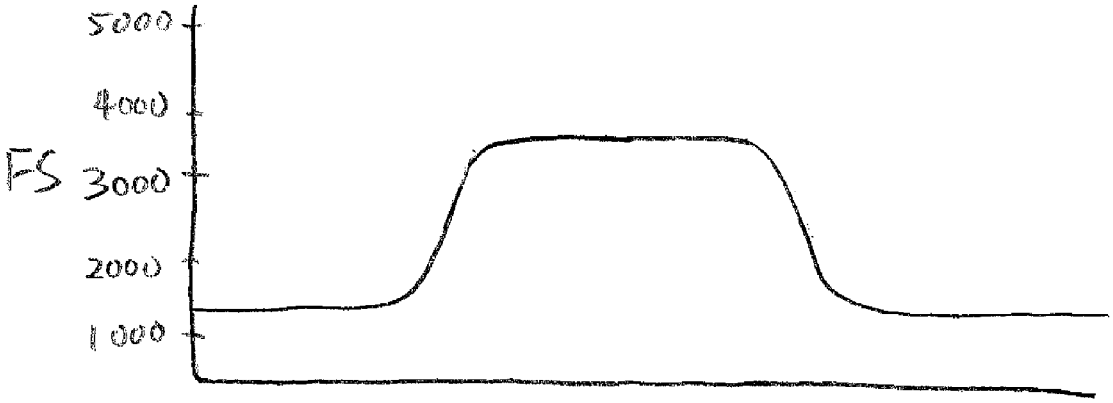
FIG. 5*d* shows the Flexural Stiffness profile of the face insert across cross-sectional area shown in FIG. 5*b;*

FIG. 5*b* shows a cross-sectional view of the current inventive face insert 506. As it can be seen, the cross-sectional view of the face insert 506 does not differ very much from the prior art face insert 406 shown in FIG. 5*b*, as the thickness' are very similar with d1 being approximately 2.5 mm and d2 being approximately 3.5 mm. However, a closer examination of the Young's modulus of the face insert 506 shown in FIG. 5*c* and the Flexural Stiffness shown in FIG. 5*d* clearly shows that the present invention differs from the prior art. More specifically, FIG. 5*c* shows that due to the heat treatment discussed above, the Young's modulus of the face insert 506 has decreased significantly from about 110 GPa to less than about 90 GPa, more preferably less than about 85 GPa, and most preferably less than about 80 GPa. The effect of this reduced Young's modulus creates a Flexural Modulus that is less than about 3,900 kN-mm at the central zone and less than about 1,500 kN-mm at the outer zone, more preferably less than about 3,650 kN-mm at the central zone and less than about 1350 kN-mm at the outer zone, and most preferably less than 3,450 kN-mm at the central zone and less than about 1250 kN-mm at the outer zone as shown in FIG. 5*d*.

Here, in this current exemplary embodiment of the present invention, the face insert 506 may generally have a Flexural Stiffness Ratio of greater than about 2.60, more preferably greater than about 2.65, and most preferably greater than about 2.70, all without departing from the scope and content of the present invention. Notice here that the peak Flexural Stiffness occurs at the central zone 501 and the trough Flexural Stiffness occurs at the outer zone 505.

Figure 6A:
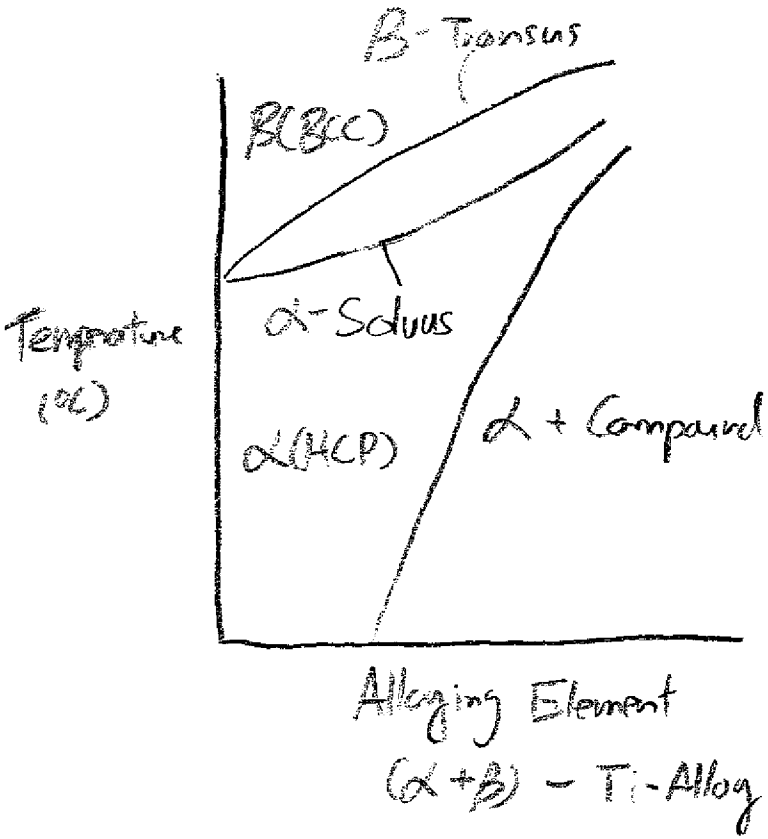
FIG. 6*a* shows a phase diagram of a titanium alloy used for the face insert in accordance with an exemplary embodiment of the present invention.
Figure 6B:
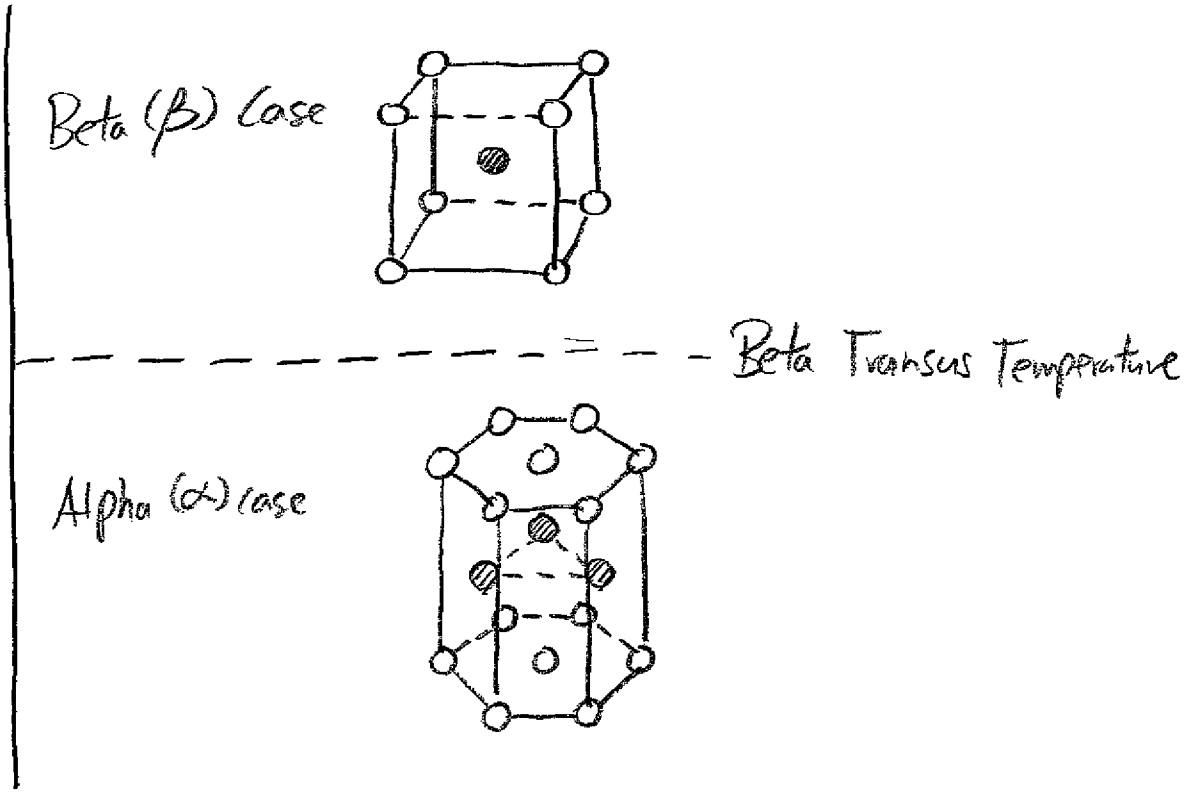
FIG. 6*b* shows the crystalline structure of the titanium alloy used for the face insert in accordance with an exemplary embodiment of the present invention.

In order to provide a clearer explanation of the interaction between α and β phases within a Titanium alloy , FIGS. 6*a* and 6*b* are provided. FIG. 6*a* is an equilibrium phase diagram of the current titanium alloy illustrating relationship of the α and β phases as a function of temperature and composition. As it can be seen in FIG. 6*a*, an α–β titanium alloy may generally have more Hexagonal Close Packed (HCP) α phase at a lower temperature. As the alloy is heated, upon reaching the α-solvus temperature, the α phase starts to transform to β phase. At the β-transus temperature all the α phase has been transformed to β. FIG. 6*b* provides a closer graphical representation of the difference between a β phase BCC structure and an α phase HCP structure, giving a visual representation of the crystalline structure. As can be seen from FIG. 6*a*, that at any temperature between α-solvus and β-transus, the alloy will be a mixture of α and β phases. The relative amounts of the phases is determined by the composition and temperature of the alloy; higher the temperature more the amount of β. Experimentally it has been found that quenching from α+β phase field is better than quenching from above the β-transus. The Young's modulus in both the cases is very similar. Thus there is no advantage to quenching from above the β-transus temperature.

Figure 7A:
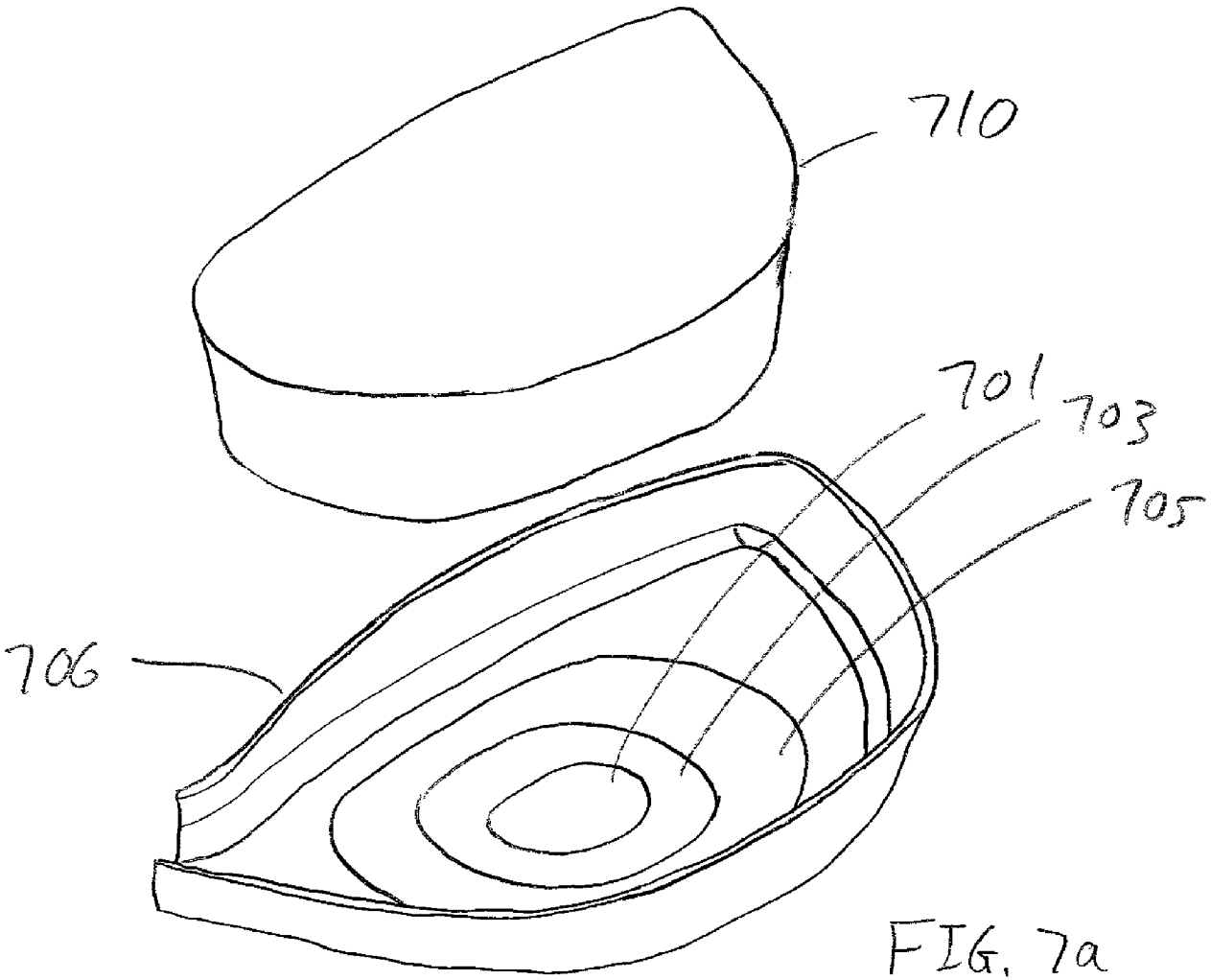
FIG. 7*a* shows a perspective view of a face cup with a die in accordance with an exemplary embodiment of the present invention.
Figure 7B:
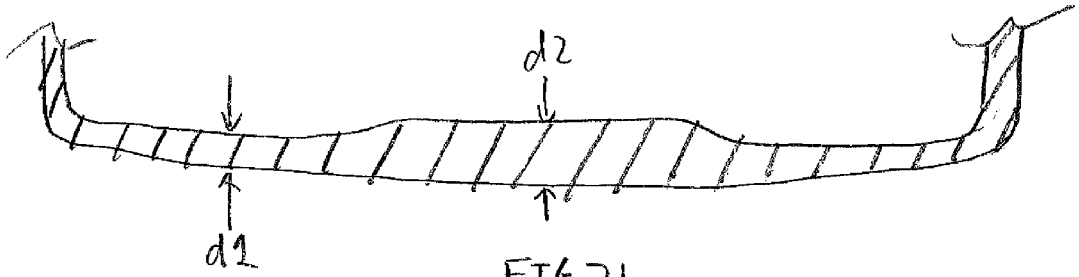
FIG. 7*b* shows a cross-sectional view of the face cup shown in FIG. 7*a;*
Figure 7C:
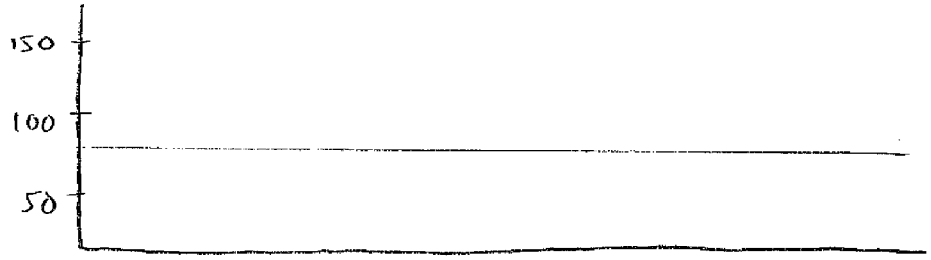
FIG. 7*c* shows the Young's modulus profile of the face cup across the cross-sectional area shown in FIG. 7*b;*
Figure 7D:
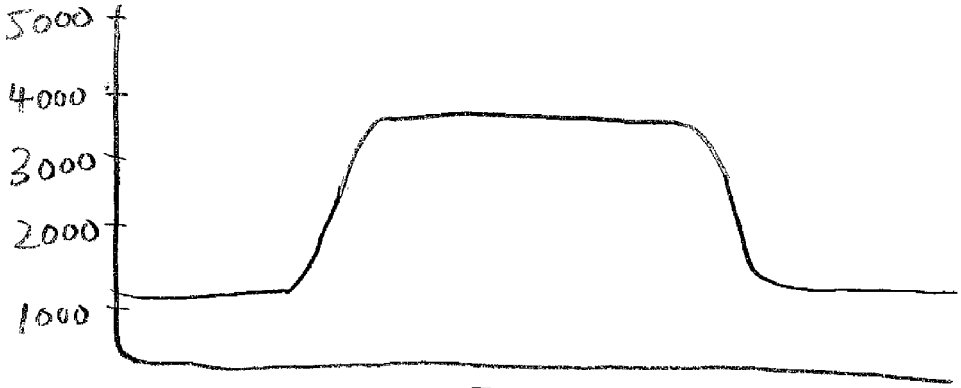
FIG. 7*d* shows the Flexural Stiffness profile of the face cup across cross-sectional area shown in FIG. 7*b;*
Figure 6A:
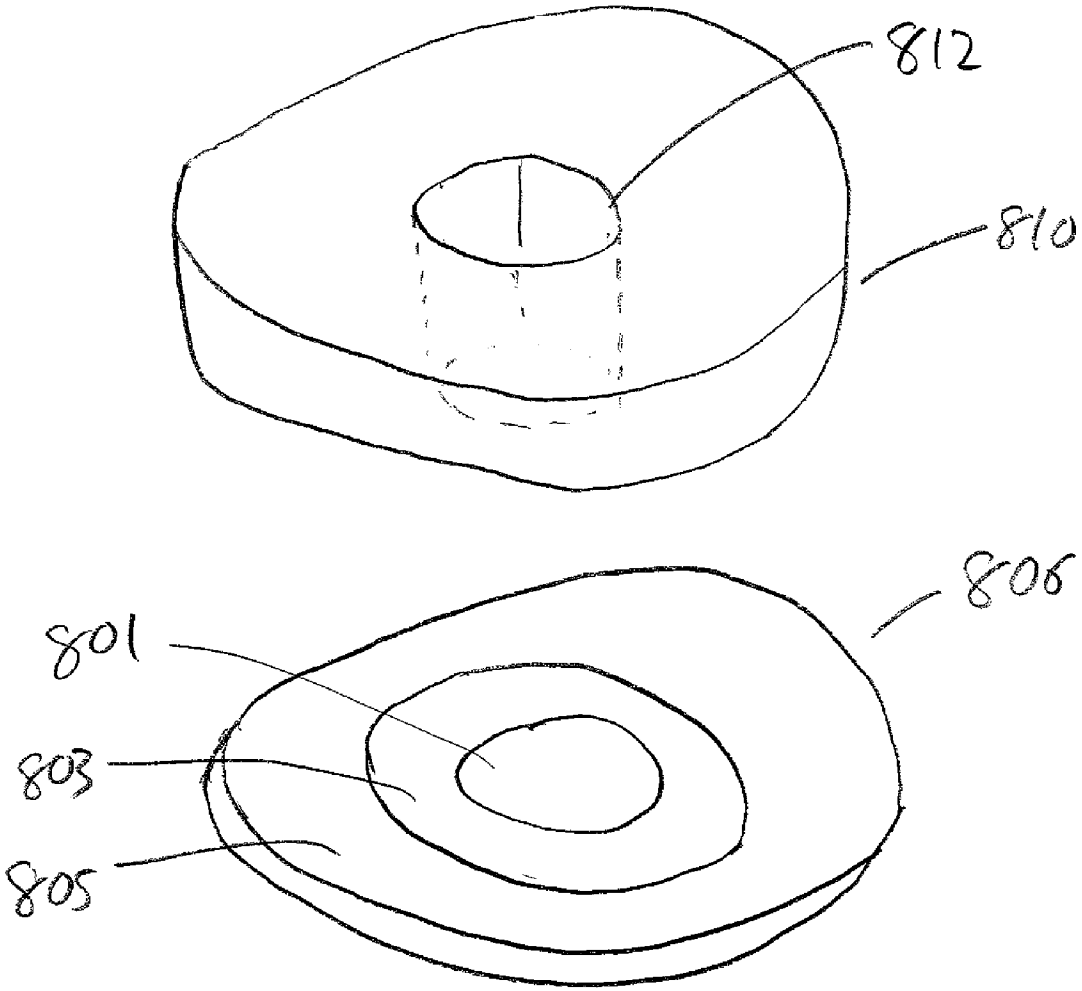

FIGS. 7*a* through 7*d* shows an alternative embodiment of the present invention wherein a face cup 706 is shown instead of a face insert 506 (shown in FIG. 5*a*). In this embodiment, the die 710 is used in the same way as previously discussed to cool the face cup 706 to create the change in Young's modulus that was previously discussed. Using the same method described above, the face cup 706 may achieve the same Young's modulus and Flexural Stiffness as a previously discussed. More specifically, FIG. 7*b* shows a cross-sectional view of the face cup 706 having a similar thickness at the ball striking region with d1 being approximately 2.5 mm and d2 being approximately 3.5 mm. Notice here in FIG. 7*c*, the Young's modulus of the face cup 706 has decreased dramatically to approximately less than about 90 GPa, more preferably less than about 85 GPa, and most preferably less than about 80 GPa. The effect of this reduced Young's modulus creates a Flexural Stiffness that is less than about 3,900 kN-mm at the central zone and less than about 1,500 kN-mm at the outer zone, more preferably less than about 3,650 kN-mm at the central zone and less than about 1350 kN-mm at the outer zone, and most preferably less than 3,450 kN-mm at the central zone and less than about 1250 kN-mm at the outer zone as shown in FIG. 7*d*.

Similar to the face insert 506 shown in FIG. 5, the face cup 706 may generally have a Flexural Stiffness Ratio of greater than about 2.60, more preferably greater than about 2.65, and most preferably greater than about 2.70, all without departing from the scope and content of the present invention.

FIG. 8*a* through 8*d* shows an alternative embodiment of the present invention wherein the die 810 may have an opening 812 to further manipulate the desired Flexural Stiffness of a face insert 806. Here, the opening 812 will allow the central portion 801 to maintain a high Flexural Stiffness while the intermediate zone 803 and the outer zone 805 may have a lower Flexural Stiffness due to the reduction in Young's modulus from the die quenching process. In order to illustrate this effect, FIGS. 8*b* through 8*d* are provided below. FIG. 8*b*, illustrates that the face insert 806 maintains a very similar geometry than all of the previous embodiments, however, a closer examination of the Young's modulus profile of the face insert 806 shows a dramatically different story, with a variable Young's modulus across the cross-section. More specifically, the central portion 801 may generally have a Young's modulus of greater than about 110 GPa, while the intermediate and outer zones 803 and 805 may generally have a lower Young's modulus of less than about 90 GPa, more preferably less than about 85 GPa, and most preferably less than about 80 GPa. The effect of this Young's modulus profile will yield a Flexural Stiffness of greater than about 4700 kN-mm at the central zone, and a Flexural Stiffness of less than about 1400 kN-mm, more preferably less than about 1350 kN-mm, and most preferably less than about 1250 kN-mm.

In this current exemplary embodiment, the maximum change in Young's modulus is greater than about 20 GPa, more preferably greater than about 25 GPa, and most preferably greater than about 30 GPa. Additionally, in this current embodiment, the Flexural Stiffness takes advantage of both the change in Young's modulus of the face insert 806 as well as the change in thickness, to create a Flexural Stiffness Ratio of greater than about 3.30, more preferably greater than about 3.50, most preferably greater than about 4.0.

Figure 9A:
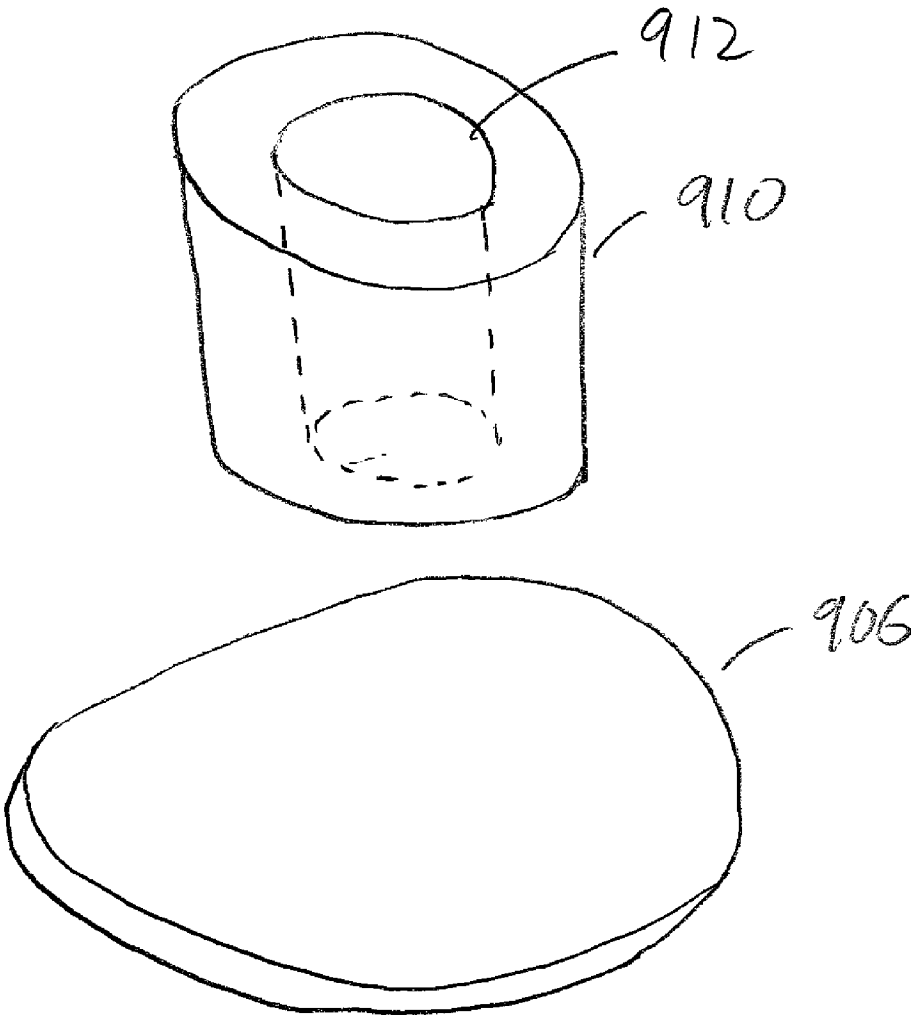
FIG. 9*a* shows a perspective view of a face insert with a die in accordance with an exemplary embodiment of the present invention.
Figure 9B:
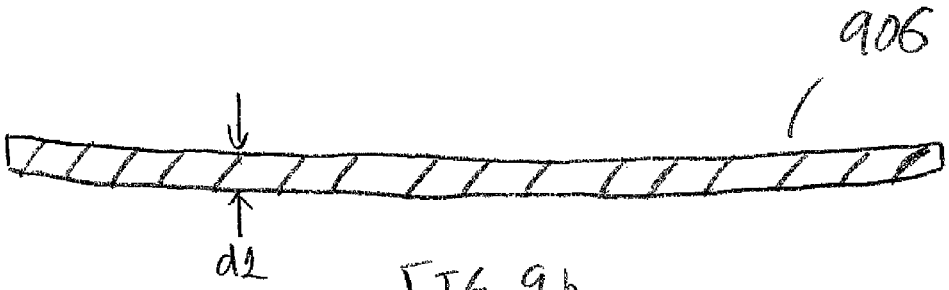
FIG. 9*b* shows a cross-sectional view of the face insert shown in FIG. 9*a;*
Figure 9C:
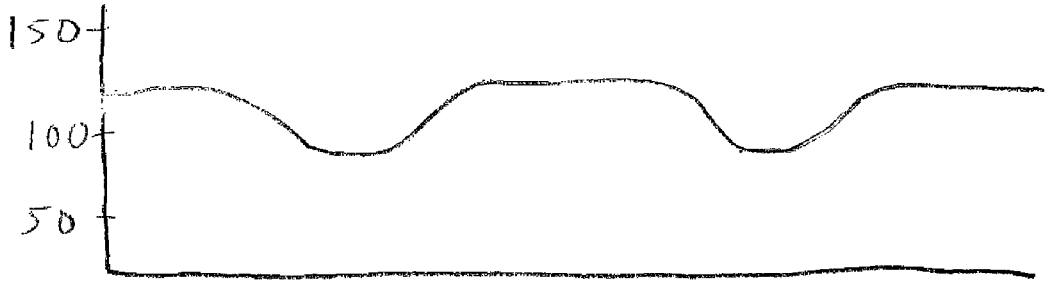
FIG. 9*c* shows the Young's modulus profile of the face insert across the cross-sectional area shown in FIG. 9*b;*
Figure 9D:
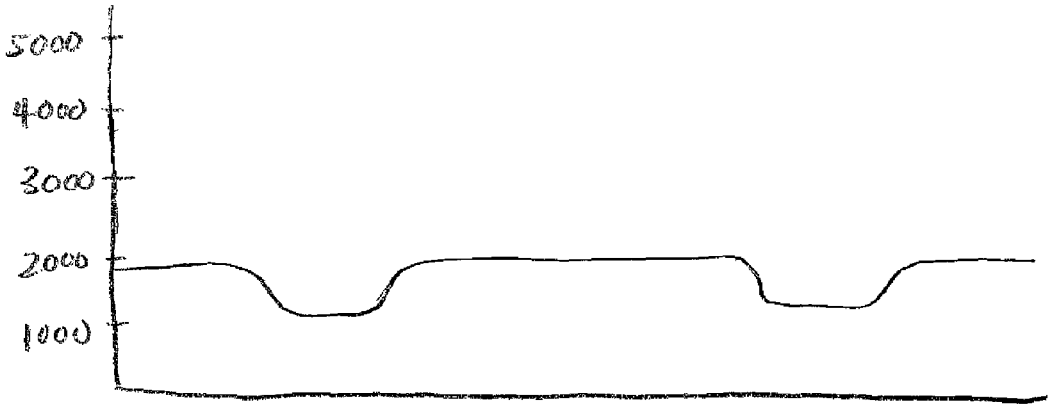
FIG. 9*d* shows the Flexural Stiffness profile of the face insert across cross-sectional area shown in FIG. 9*b;*

FIG. 9*a* through 9*d* show a further alternative embodiment of the present invention, wherein a die 910 may have an opening 912 similar to the prior embodiment, but the boundaries of the die 910 do not extend to the boarders of the face insert 906, forming a circular doughnut shape. This particular doughnut shaped die can be used on a face insert 906 without a variable thickness to simulate the effect that increases ball speed across a greater portion of the face. In order to understand this embodiment, FIG. 9*b* show a cross-sectional view of the face insert 906 having a constant thickness d1 throughout. In one embodiment, the thickness d1 may generally be about 2.5 mm. FIG. 9*c* shows the effect of this alternative die 910 on the Young's modulus of the face insert 906, which yields a lower Young's modulus of about 70 GPa at portions wherein the die 910 comes into contact with the face insert 906 while maintaining a Young's modulus of about 110 GPa at portions wherein the conductive heat transfer did not take place. Finally, as shown in FIG. 9*d*, the Flexural Stiffness of this alternative embodiment at its peak near the central zone and the outer zone at approximately 1700 kN-mm while the intermediate zone has a Flexural Stiffness of less than about 1250 kN-mm.

Ultimately, the face insert 906 in accordance with this embodiment of the present invention may generally have a Flexural Stiffness Ratio of about 1.36. Notice in this embodiment, the peak Flexural Stiffness occurs at the center of the golf club, while the trough Flexural Stiffness occurs near an intermediate zone.

Figure 10A:
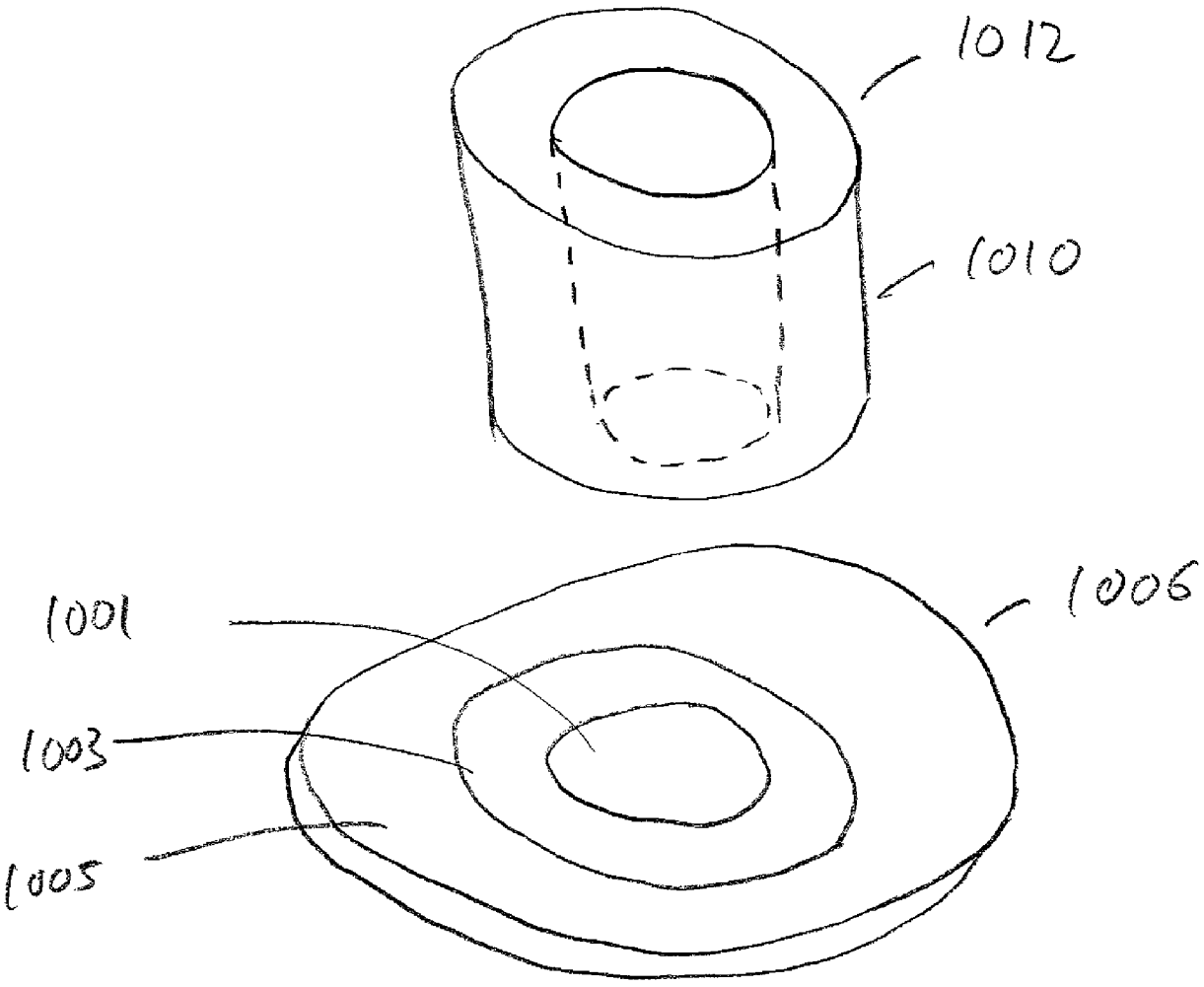
FIG. 10*a* shows a perspective view of a face insert with a die in accordance with an exemplary embodiment of the present invention.
Figure 10B:
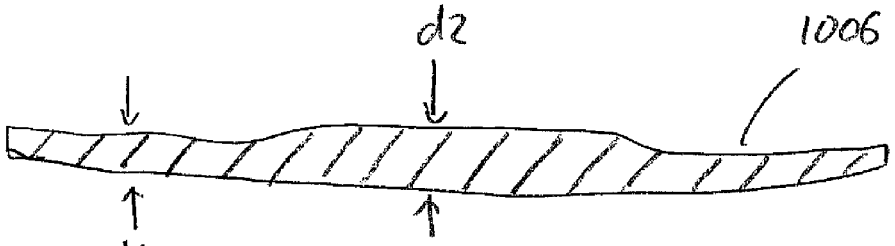
FIG. 10*b* shows a cross-sectional view of the face insert shown in FIG. 10*a;*
Figure 10C:
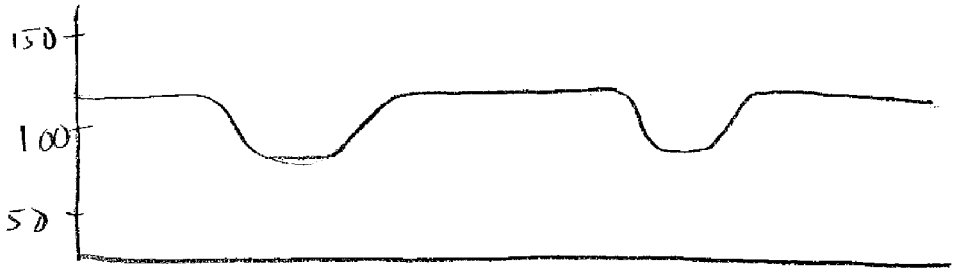
FIG. 10*c* shows the Young's modulus profile of the face insert across the cross-sectional area shown in FIG. 10*b;*
Figure 10D:
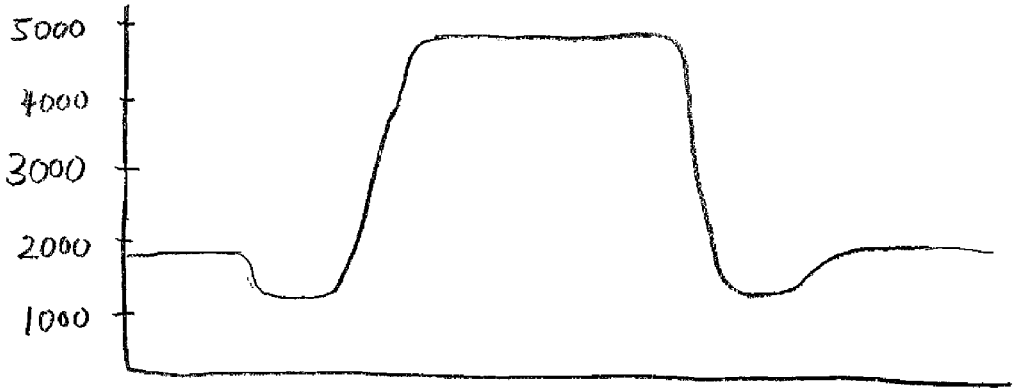
FIG. 10*d* shows the Flexural Stiffness profile of the face insert across cross-sectional area shown in FIG. 10*b;*

FIG. 10*a* through 10*d* of the accompanying drawings show an even further alternative embodiment of the present invention wherein a doughnut shaped die 1010 having an opening 1012 can be used in combination with a face insert 1006 that has a variable thickness. Having seen the cross-section of the face insert 1006 shown in FIG. 10*b*, the Young's modulus of a this face insert 1006 may generally change from about 70 GPa at portions where the die 1010 comes in contact with the face insert 1006 and about 110 GPa at portions wherein the conductive heat transfer did not take place as shown in FIG. 10*c*. Similarly, FIG. 10*d* shows the Flexural Stiffness of the face insert 1006 across the cross-section, having a peak Flexural Stiffness of about 4700 kN-mm and a trough Flexural Stiffness of about 1200 kN-mm, yielding a Flexural Stiffness Ratio of about 4.0.

Figure 11A:
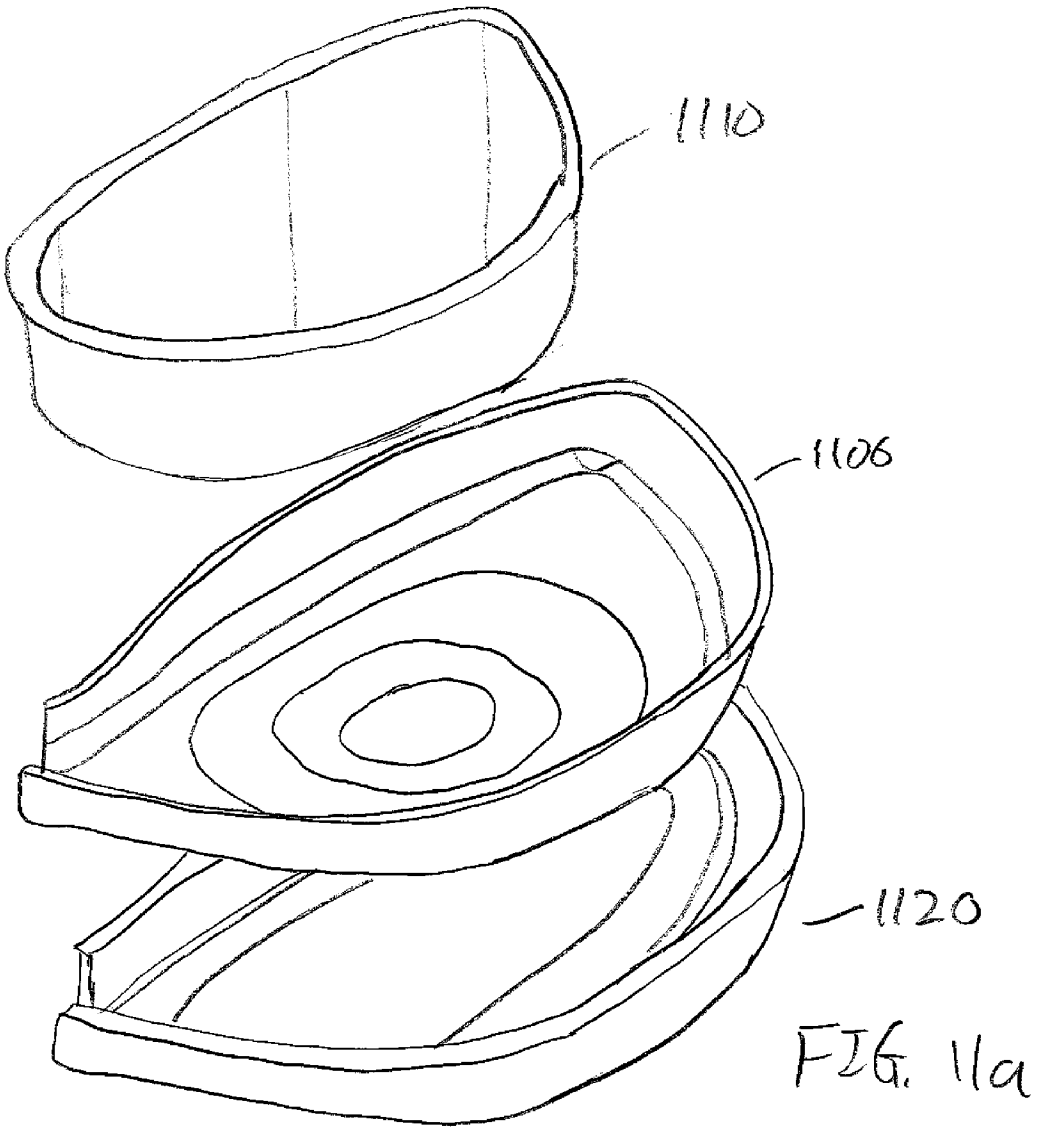
FIG. 11*a* shows a perspective view of a face cup with a die in accordance with an alternative embodiment of the present invention.
Figure 11B:
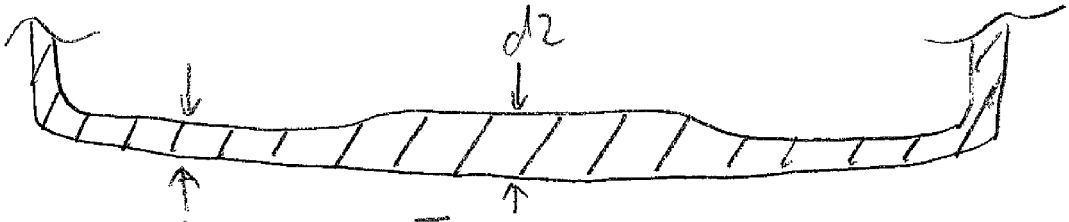
FIG. 11*b* shows a cross-sectional view of the face cup shown in FIG. 11*a;*
Figure 11C:
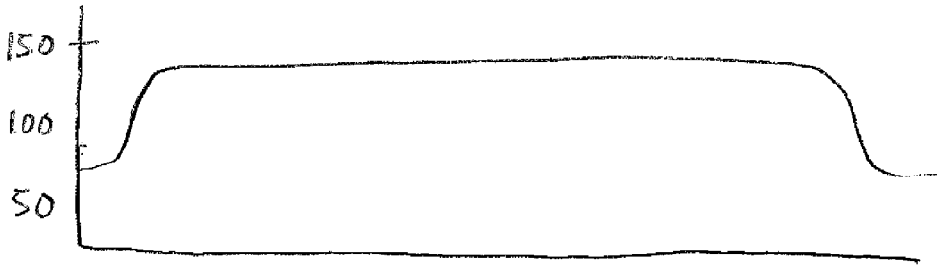
FIG. 11*c* shows the Young's modulus profile of the face cup across the cross-sectional area shown in FIG. 11*b*.
Figure 11D:
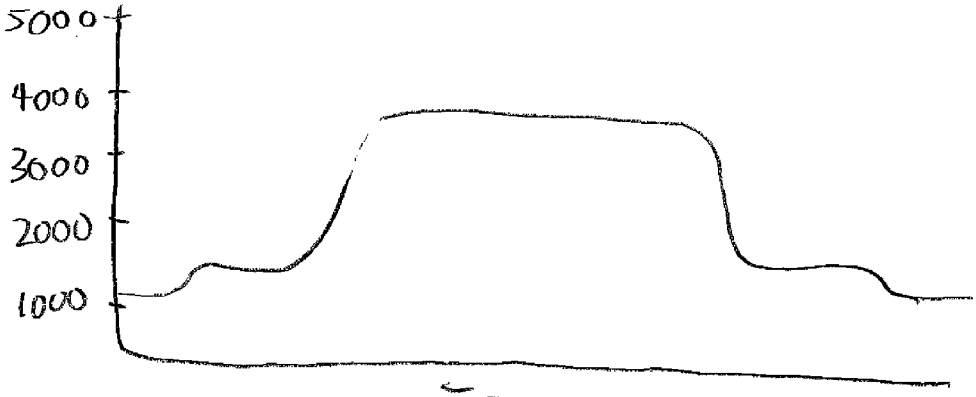
FIG. 11*d* shows the Flexural Stiffness profile of the face cup across cross-sectional area shown in FIG. 11*b*.

FIGS. 11*a* through 11*d* of the accompanying drawings show an alternative embodiment of the present invention, wherein a face cup 1106 utilizes a top die 1110 and a bottom die 1120 to create an alternative Young's modulus profile. The top die 1110, as shown in the embodiment, may generally be ring shaped, allowing the Young's modulus of the perimeter of the face cup 1106 to be adjusted. Additionally, the bottom die 1120 utilizes a cup type geometry with an opening in the center to concentrate the quenching process near the perimeter of the face cup 1106. The resultant face cup, as it can be seen by the cross-sectional diagram in FIG. 11*b*, may look similar to previous face cup designs in terms of thickness, but will have a dramatically different Young's modulus profile as observed in FIG. 11*c*. More specifically, the perimeter of the face cup 1106 may have a Young's modulus of less than about 70 GPa, while the center of the face cup will maintain a Young's modulus of greater than about 110 GPa. Finally, FIG. 11*d* shows the Flexural Stiffness of the face cup 1106, indicates that the extreme perimeter of the face cup 1106 will generally have a Flexural Stiffness of less than about 1200 kN-mm, while the intermediate portion will generally have a Flexurall Stiffness of less than about 1800 kN-mm, and the central portion having a Flexural Stiffness of greater than about 4700 kN-mm, yielding a Flexural Stiffness Ratio of about 4.0.

Although all of the proceeding discussion relates to the incorporation of the die quenching process on the striking face of a golf ball, the same process could be applied to different portions of the golf club head such as the crown, the sole, the hosel, or even the skirt all without departing from the scope and content of the present invention. Additionally, the same die quenching process discussed above is not limited to a metalwood type golf club, but could extend to cover iron type golf clubs as well without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the aforementioned specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion; and an aft portion, attached to a rear of said striking face portion;

wherein said striking face portion is made out of an α-β titanium alloy comprising at least one of a body centered cubic β titanium alloy;

wherein at least a portion of said striking face portion has a Young's modulus of less than about 80 GPa, and wherein said striking face portion has a variable Young's modulus across at least one cross-sectional area.

2. The golf club head of claim 1, wherein said striking face portion has a striking face with a maximum change in Young's modulus of greater than about 20 GPa.

3. The golf club head of claim 2, wherein said striking face portion has a striking face with a maximum change in Young's modulus of greater than about 25 GPa.

4. The golf club head of claim 3, wherein said striking face portion has a striking face with a maximum change in Young's modulus of greater than about 30 GPa.

5. The golf club head of claim 1, wherein said striking face portion has a Flexural Stiffness Ratio of greater than about 2.6, said Flexural Stiffness Ratio defined as a peak Flexural Stiffness of said striking face portion divided by a trough Flexural Stiffness of said striking face.

6. The golf club head of claim 5, wherein said striking face portion has a Flexural Stiffness Ratio of greater than about 2.65.

7. The golf club head of claim 6, wherein said striking face portion has a Flexural Stiffness Ratio of greater than about 4.0.

8. The golf club head of claim 1, wherein said α-β titanium alloy has Molybdenum Equivalency of between 4.0 and 9.75.

9. A golf club head comprising:

a striking face portion; and an aft portion, attached to a rear of said striking face portion;

wherein said striking face portion is made out of a titanium alloy SP-700 material, wherein at least a portion of said striking face portion has a Young's modulus of less than about 90 GPa, and wherein said striking face portion has a variable Young's modulus across at least one cross-sectional area.

10. The golf club head of claim 9, wherein said α- β titanium alloy has Molybdenum Equivalency of less than about 9.5.

11. The golf club head of claim 9, wherein said striking face portion has a striking face with a maximum change in Young's modulus of greater than about 20 GPa.

12. The golf club head of claim 11, wherein said striking face portion has a striking face with a maximum change in Young's modulus of greater than about 25 GPa.

13. The golf club head of claim 12, wherein said striking face portion has a striking face with a maximum change in Young's modulus of greater than about 30 GPa.

* * * * *